US006572190B2

(12) United States Patent
Koepke et al.

(10) Patent No.: US 6,572,190 B2
(45) Date of Patent: Jun. 3, 2003

(54) LUMBAR SUPPORT FOR A CHAIR

(75) Inventors: Marcus C. Koepke, Indianapolis, IN (US); Jay R. Machael, Muscatine, IA (US); Matthew J. Phillips, Muscatine, IA (US); Douglas A. Schroeder, Muscatine, IA (US); Craig H. Schultz, Muscatine, IA (US); Erik A. Steffensen, Iowa City, IA (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 09/881,795

(22) Filed: Jun. 15, 2001

(65) Prior Publication Data

US 2002/0190552 A1 Dec. 19, 2002

(51) Int. Cl.[7] ..... A47C 7/46; A47C 3/025

(52) U.S. Cl. ..... 297/284.1; 297/284.4; 297/284.7

(58) Field of Search ..... 297/284.1, 284.7, 297/284.4

(56) References Cited

U.S. PATENT DOCUMENTS

| | | | | |
|---|---|---|---|---|
| 2,059,940 A | | 11/1936 | Freedman | |
| 3,019,051 A | | 1/1962 | Nugent | |
| 3,258,259 A | | 6/1966 | Bohlin | |
| 3,711,156 A | | 1/1973 | Bloomfield | |
| 3,762,769 A | * | 10/1973 | Poschl | 297/284.1 |
| 3,794,382 A | | 2/1974 | Bloomfield et al. | |
| 4,155,592 A | | 5/1979 | Tsuda et al. | |
| 4,159,847 A | | 7/1979 | Arai | |
| 4,309,058 A | | 1/1982 | Barley | |
| 4,634,178 A | * | 1/1987 | Carney | 297/284.7 |
| 5,507,559 A | | 4/1996 | Lance | |
| 5,797,652 A | | 8/1998 | Darbyshire | |
| 5,975,632 A | * | 11/1999 | Ginat | 297/284.7 |
| 6,050,646 A | | 4/2000 | Stenzel et al. | |

* cited by examiner

*Primary Examiner*—Anthony D. Barfield
(74) *Attorney, Agent, or Firm*—Jones Day

(57) ABSTRACT

A lumbar support for a chair having a flexible back, includes at least one generally vertical support member disposed to the rear of the chair back. A transverse member engages the vertical support and has opposed ends provided with grippers for gripping opposed edges of the flexible back. The transverse member is configured to force the opposed edges of the flexible back forwardly of the chair back in the lumbar region of the user to provide support therefor. The transverse member may also be configured to slide on the vertical support to provide for height adjustability of the lumbar support of the fabric.

42 Claims, 26 Drawing Sheets

LUMBAR SUPPORT FOR A CHAIR

BACKGROUND OF THE INVENTION

1. Field of the Invention

The present invention relates generally to a chair of the type suitable for use in an office environment and, more particularly, to a reclining office chair having several structural and operating features which offer a number of ergonomic advantages over the prior art including a highly functional adjustable lumbar support.

2. Description of the Related Art

Over many years attempts have been made to design chairs for use in office environments which are comfortable to use and thereby avoid user fatigue over prolonged use. In one simple form a chair may be provided with a swivel base for ease of turning and include a control mechanism which permits the chair to rock. A disadvantage of these relatively simple chairs is that conjoint rocking motion of the chair seat and back naturally lifts the user's feet off the floor, which can create stability problems and place upward force on the front of the user's thighs which can reduce fluid circulation in the user's legs.

To improve on the foregoing chair construction, chair controls are known which provide for synchronous movement of the chair seat and back. Where office chairs are concerned, a "synchronous control" means the arrangement of a combined or dependent back adjustment and seat adjustment, that is to say the adjustment of the back inclination fundamentally also results in an adjustment of the sitting surface. An example of a synchronous chair control is disclosed in U.S. Pat. No. 5,318,345, issued to Olson and assigned to the common assignee herein. With the aforementioned Olson control, the chair back is designed to tilt at one predetermined rate of recline while the seat tilts synchronously at a much lesser rate. The result is that the user's feet are not lifted from the floor when the back is reclined. Also, fluid circulation in the user's legs is not interrupted by substantial upward movement of the forward end of the seat. Another advantage of this control is that undesirable "shirt pull" is minimized by the strategic location of the tilt axis. Other examples of synchronous chair controls are disclosed in U.S. Pat. Nos. 5,366,274 and 5,860,701 to name a few.

Another feature embodied in recently designed office chairs that offers considerable ergonomic advantages is a tilt limiter feature for the chair back. With such a mechanism built into the chair control, the user may selectively set the degree of back recline at a predetermined angle thereby adding to comfort as the chair is used. An example of such a tilt limiter mechanism is disclosed in U.S. Pat. No. 6,102,477 issued to Kurtz and assigned to the common assignee herein. This particular mechanism offers the advantage of providing for infinitely variable angles of tilt within a predetermined overall range. The mechanism is also highly cost-effective to construct.

Yet another feature of current ergonomically designed chairs is the provision of height and pivot adjustable arm pads. Such a feature is particularly advantageous in providing the user with additional support to the arms, forearms, wrists and shoulders in order to minimize repetitive stress injuries when the user is keyboarding, for example, while seated in the chair. An example of such an adjustable arm pad is disclosed in U.S. Pat. No. 5,908,221 issued to Neil. One advantage of the '221 structure is that it uses gas cylinders for arm pad height adjustment and thus is easily adjusted with the push of a single button.

Yet another feature of current ergonomically designed office chairs includes an adjustable lumbar support mechanism for providing preselected chair back tension in the region of the user's lower back. An adjustable lumbar support allows the chair user to select a comfortable level of pressure on the lower back depending upon the specific office task being performed. Such a mechanism is disclosed, for example, in U.S. Pat. No. 5,797,652.

Still another feature of certain ergonomically designed office chairs, particularly of recent vintage, is the incorporation of fabric mesh into the construction of the chair seat, and/or back. While mesh materials are well-known in the construction of lawn furniture seating, it has only been relatively recently that such materials have been used successfully in office seating. These materials offer the advantage of enhanced air circulation for and consequent heat transfer from the chair user's body, which can improve the comfort of the chair. An example of the use of such fabric mesh in an office chair is disclosed in U.S. Pat. No. 6,125,521 issued to Stumpf et al.

Yet another feature of certain ergonomically designed chairs is the provision of a seat cushion having the capability of effecting heat transfer from the chair user's buttocks area while at the same time offering comfort to the user while seated, together with adequate support. Known seat cushions having such capability may involve a passive or active air flow circulation feature of the type disclosed, for example, in U.S. Pat. No. 6,179,706.

SUMMARY OF THE INVENTION

The present invention provides a totally redesigned ergonomic chair that incorporates improved functional aspects in all areas of a modular chair construction and in its use, including tilt mechanism, tilt limit control, seat adjustment, arm adjustment, lumbar support, cushion airflow, mesh attachment and casters.

The various subfeatures of these modular components are the subject of the following individual applications filed of even date herewith, all commonly assigned, the disclosures of which are incorporated in full by reference:

Multi-position Tilt Limiting Mechanism U.S. application Ser. No. 09/882,500, filed Jun. 15, 2001

Locking Device for Chair Seat Horizontal Adjustment Mechanism U.S. application Ser. No. 09/881,896, filed Jun. 15, 2001

Height and Pivot Adjustable Chair Arm U.S. application Ser. No. 09/881,818, filed Jun. 15, 2001

Body Support Member U.S. application Ser. No. 09/882,503, filed Jun. 15, 2001

Chair Back Construction U.S. application Ser. No. 09/882,140, filed Jun. 15, 2001

Chair of Modular Construction U.S. application Ser. No. 09/881,897, filed Jun. 15, 2001

Ergonomic Chair U.S. application Ser. No. 09/882,237, filed Jun. 15, 2001

In each of these cases, features combine to provide an overall chair that is a significant improvement over the prior art.

Thus, for example, the ergonomic chair provides a reclining chair having a four bar linkage system that causes the rear of the seat to elevate as the back is reclined lending an unusual and comfortable balance during reclining. A tilt limit control conveniently and effectively limits the degree of chair back tilt to one of three reclined positions by manual movement of a simple lever. Horizontal positioning of the chair seat cushion is accomplished using a simple locking device that allows the chair user to simply lift up on the front of the cushion and select a preferred horizontal cushion position. Height and pivot adjustable chair arms are actuated with the push of a button by gas cylinders lending convenient adjustment to suit a specific work task. A lumbar support is easily height adjustable, by providing tension to the back frame and requires no screws or adjustment knobs in its adjustment mechanism. A modular cushion includes a comfortable heat absorbing gel layer and is vented uniquely for air circulation. The back of the chair is of fabric mesh construction and includes a novel attachment system for superior comfort. The base of the chair is of modular construction that provides for ease of assembly and lends rigidity to the chair construction.

The present invention improves over the prior art by providing a chair with a lumbar support assembly, the chair having a flexible back, and including at least one generally vertical support member disposed to the rear of the chair back. A transverse member engages the vertical support and has opposed ends provided with grippers for gripping opposed edges of the flexible back. The transverse member is configured to force the opposed edges of the flexible back forwardly of the chair back in the lumbar region of the user to provide support therefor. The transverse member may also be configured to slide on the vertical support to provide for height adjustability of the lumbar support of the fabric.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
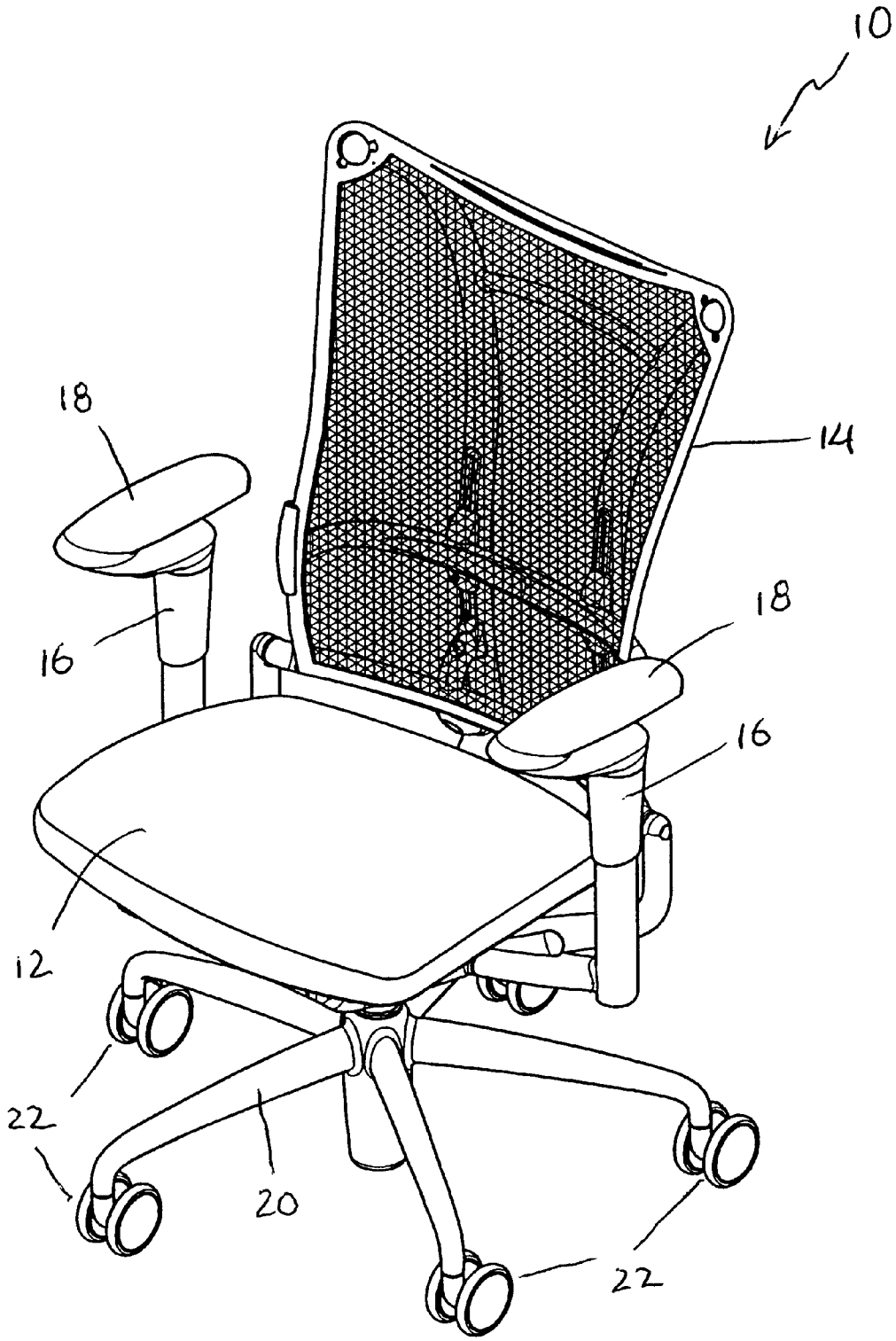
FIG. 1 is a left front perspective view of an ergonomic chair constructed in accordance with the principles of the invention and incorporating all of the improved modular components.
Figure 2:
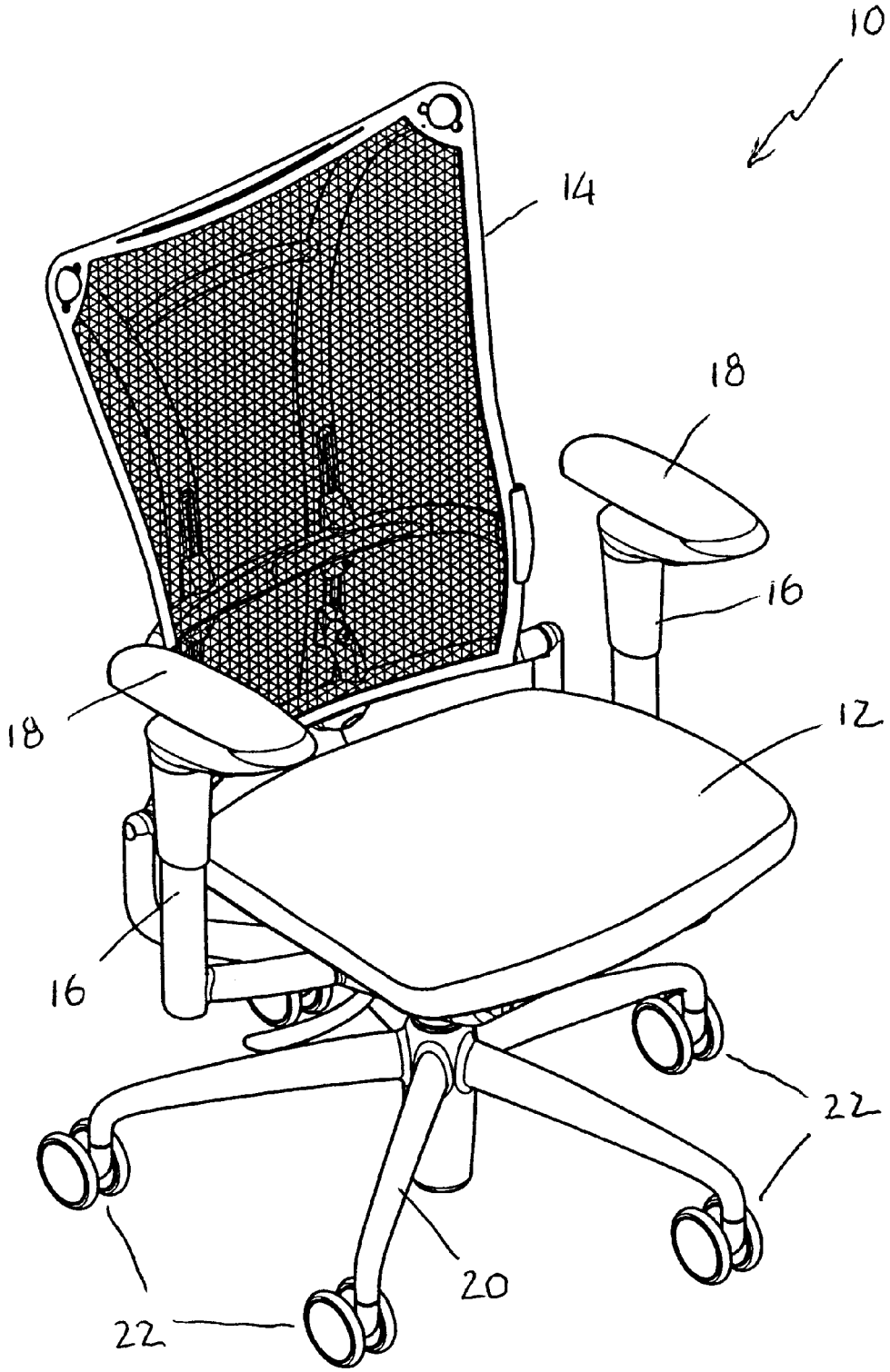
FIG. 2 is a right front perspective view thereof.
Figure 2A:
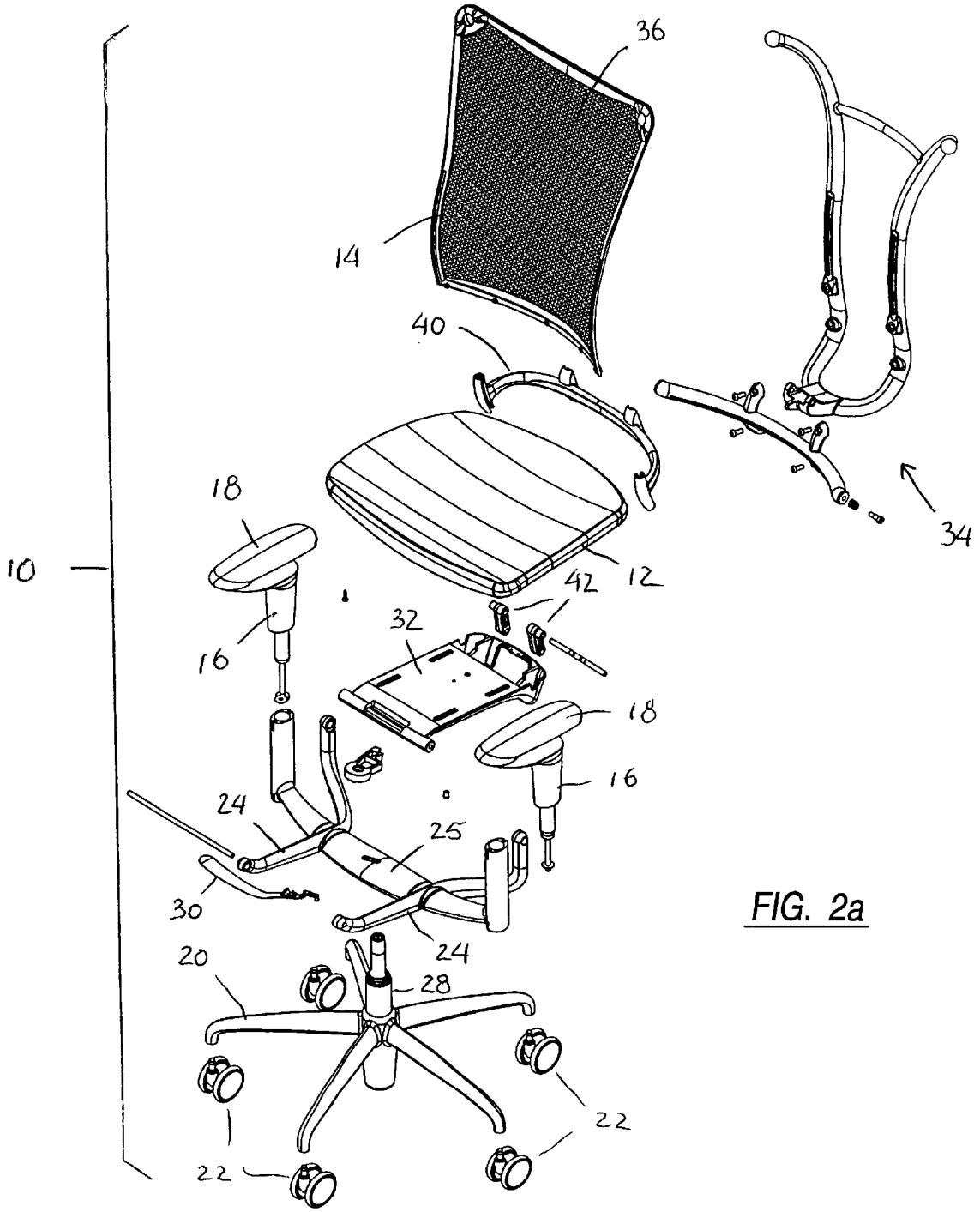
FIG. 2*a* is an exploded perspective view thereof.
Figure 3:
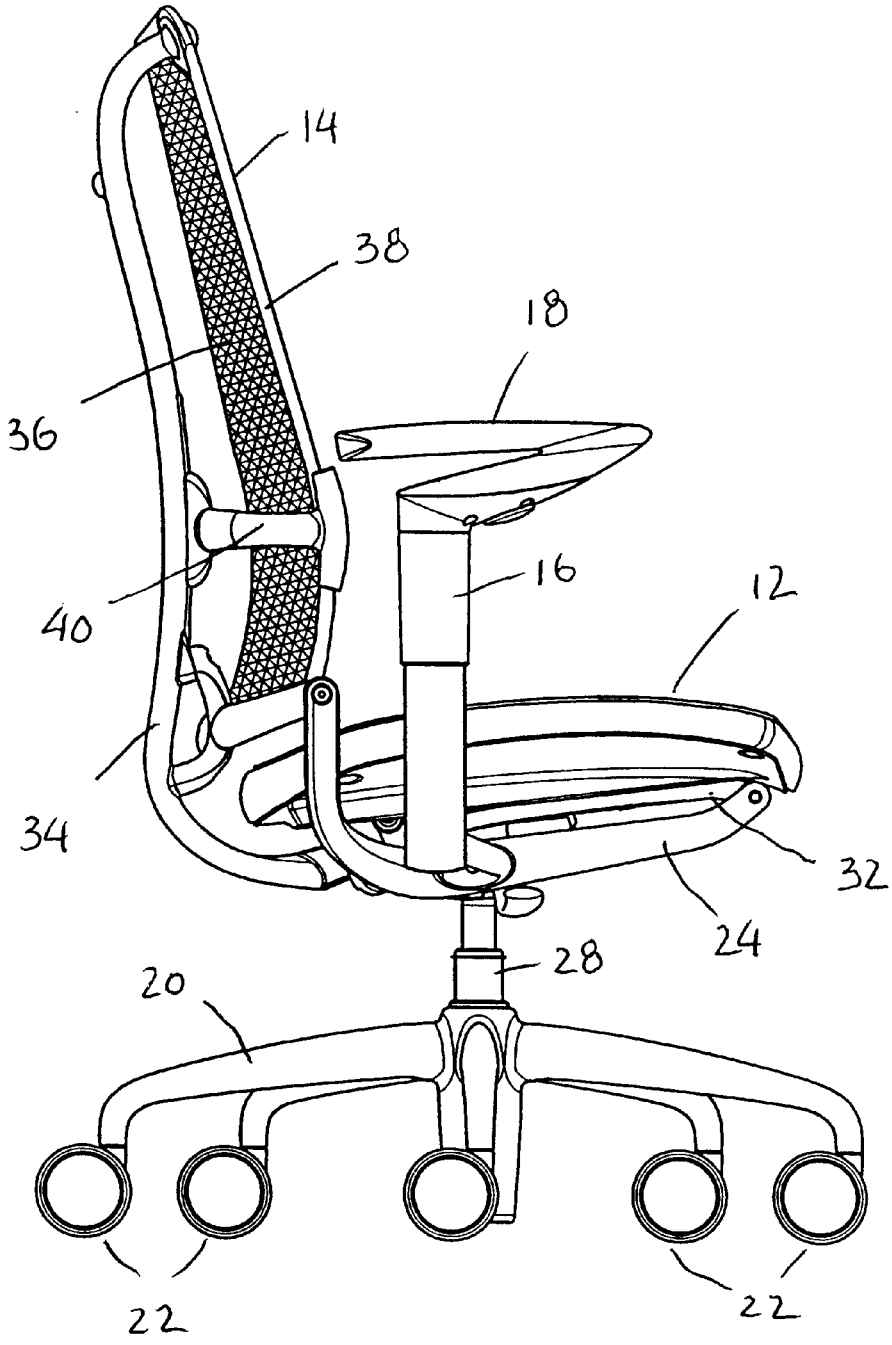
FIG. 3 is a right side view thereof.
Figure 4:
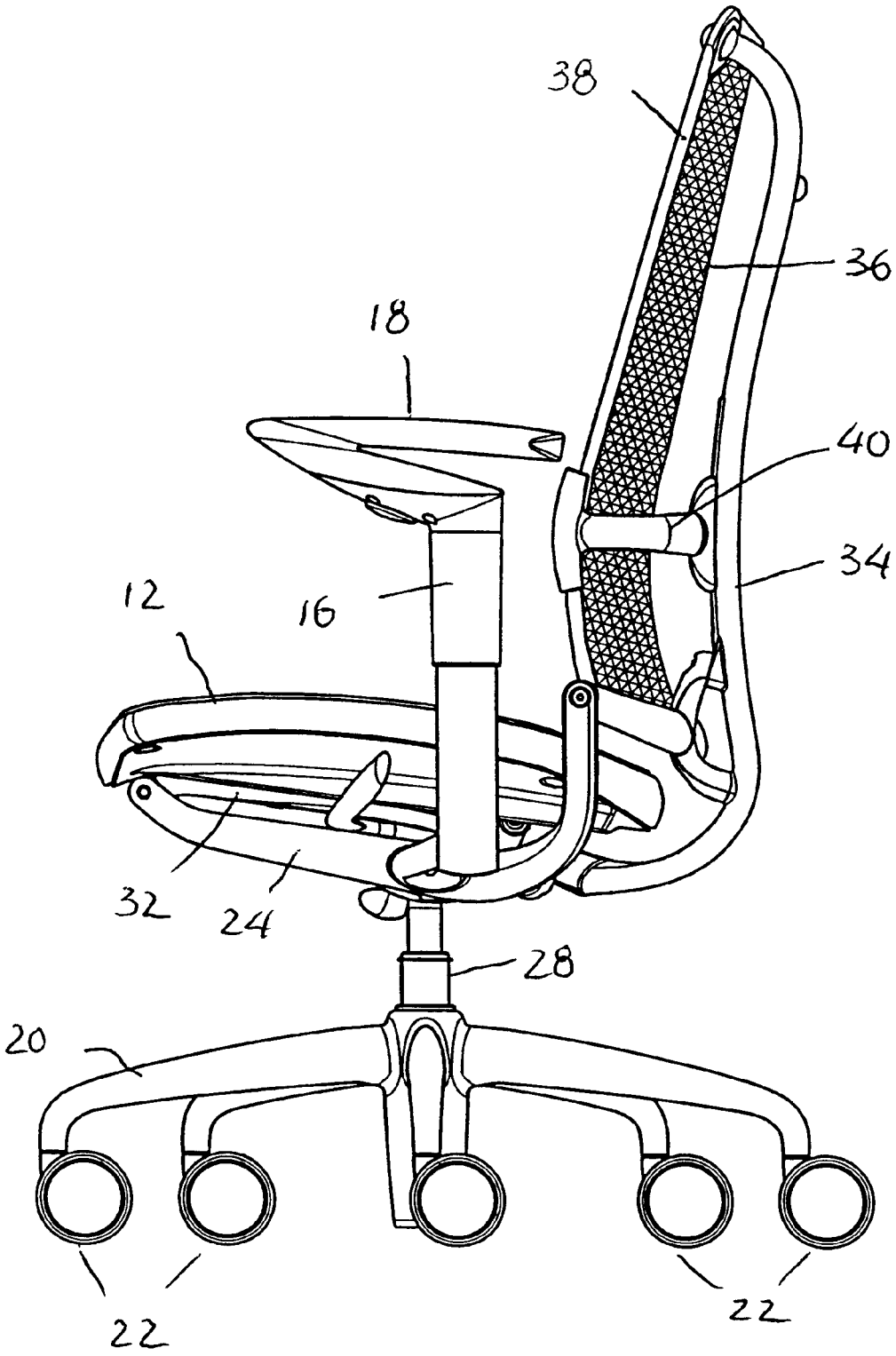
FIG. 4 is a left side view thereof.
Figure 5:
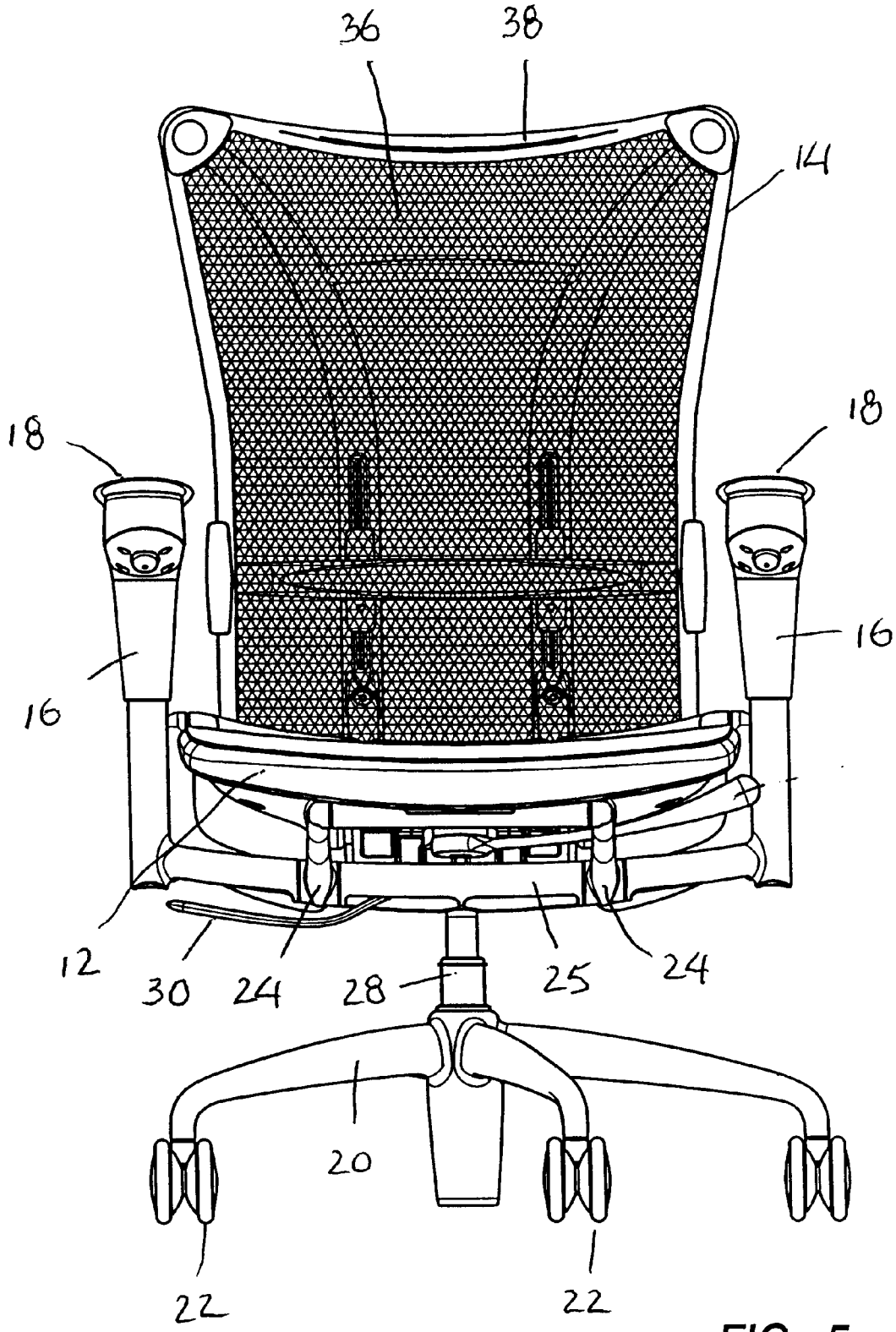
FIG. 5 is a front view thereof.
Figure 6:
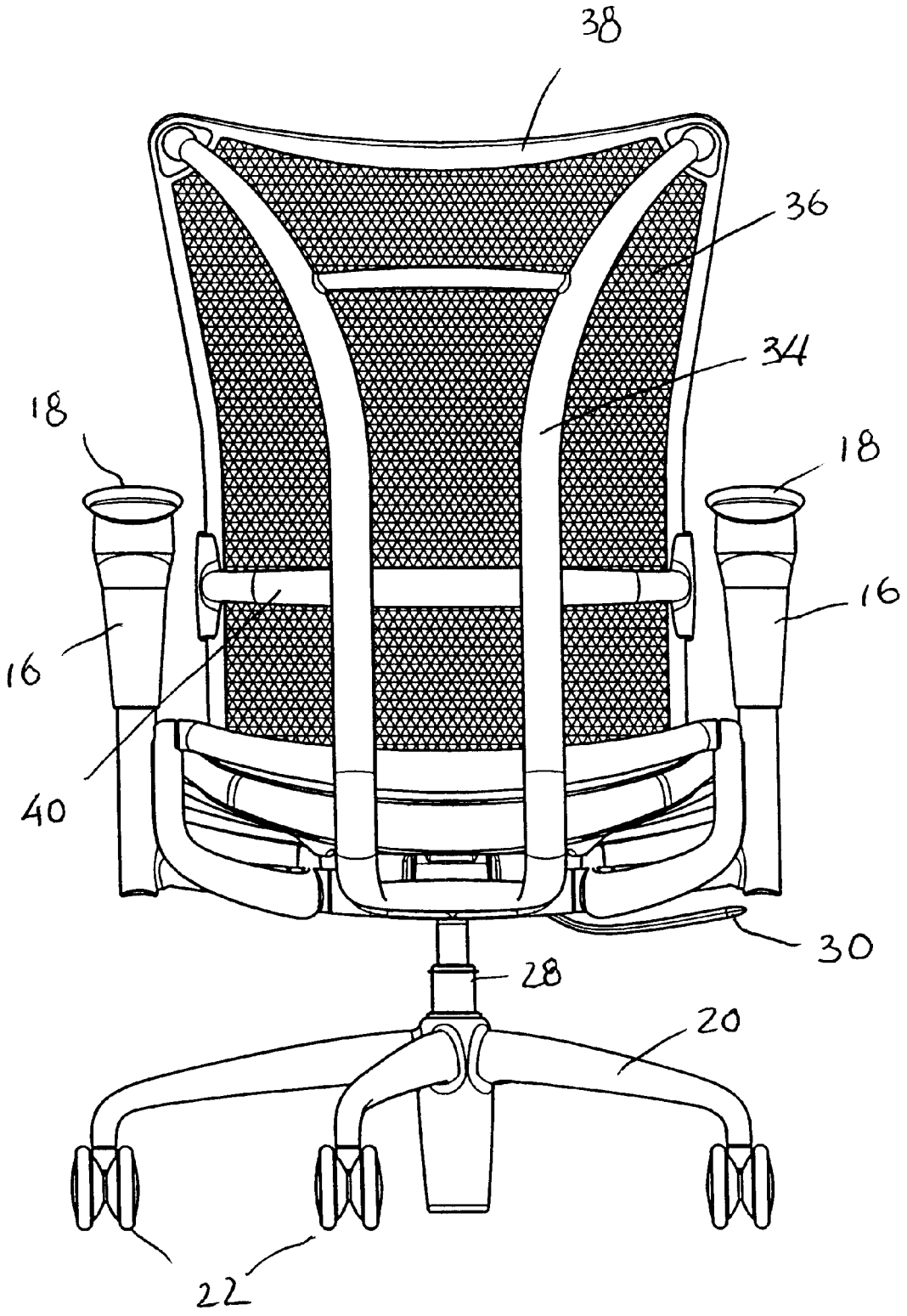
FIG. 6 is a rear view thereof.
Figure 7:
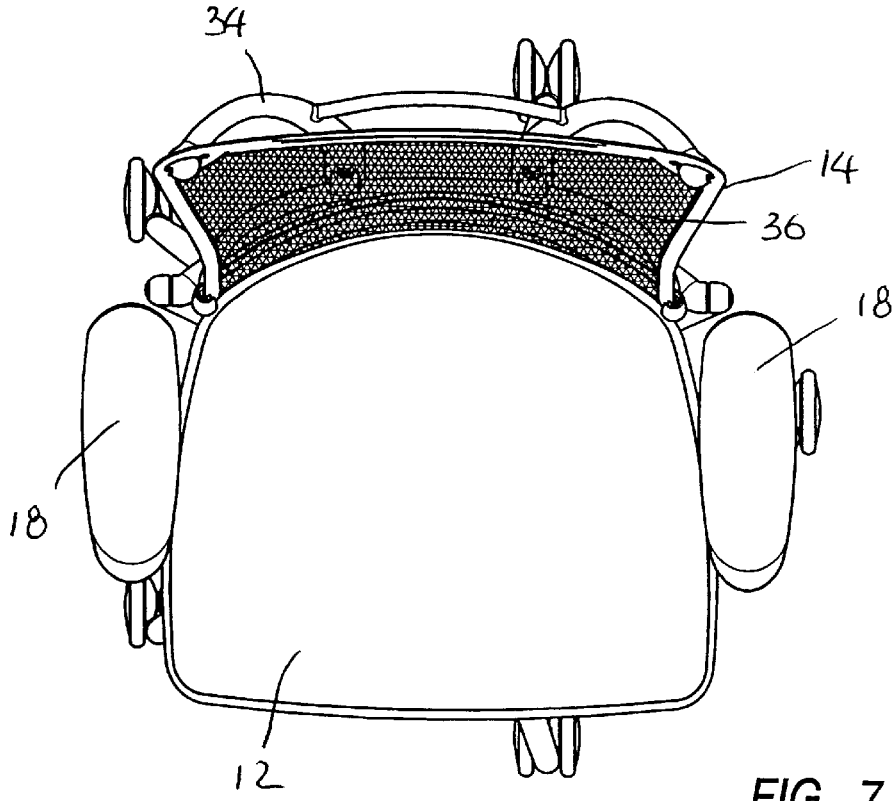
FIG. 7 is a top view thereof.
Figure 8:
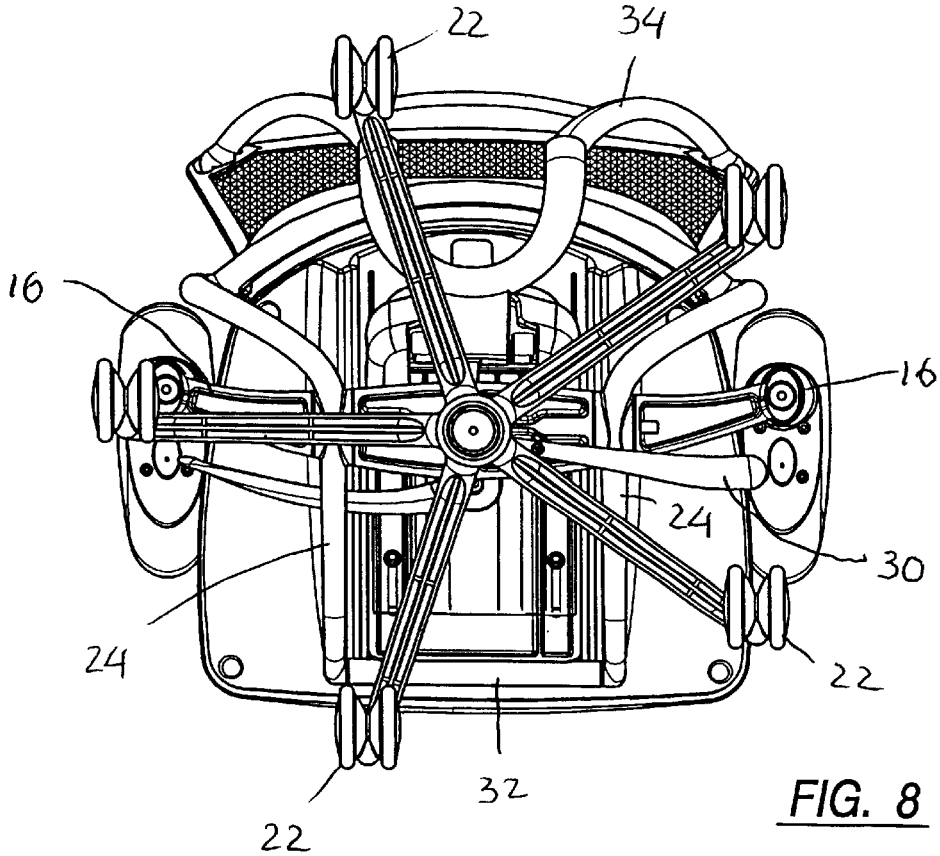
FIG. 8 is a bottom view thereof.

Referring now to the drawings, and initially to FIGS. 1, 2 and 2*a*, an improved ergonomic chair constructed in accordance with the numerous principles of the invention is shown in front perspective and designated generally by the reference numeral 10. The chair 10 comprises as its principal components a seat 12 and back 14. Suitable arms 16 having upper pads 18 may be provided. The chair 10, in a conventional manner, may be supported on a spider base 20 movable on casters 22.

As shown in FIGS. 3–9, the chair 10 is so constructed as to have synchronous movement of the seat 12 and back 14. To this end, a pair of main seat and back supports 24 are rigidly attached to a central support module 25 having a hub 26 for frictionally receiving the upper end of a gas cylinder 28. The gas cylinder 28 is preferably a two-stage type available from Stablis GmbH of Germany. This cylinder 28 is operable by a manually pivotable lever 30 which activates the cylinder 28 for height and adjustability of the chair 10 in a manner well-known in the art. The chair arms 16 are rigidly connected to the supports 24. A seat pan 32 is pivotably connected at its front end to the forward end of the supports 24. A back frame assembly 34 is also pivotably connected to the upper rear of the supports 24. The chair back 14 in the preferred embodiment is of fabric mesh 36 construction supported around its periphery by a carrier 38. An adjustable lumbar support member 40 slidably connects to the carrier 38 and bears against the back frame assembly 34.

Figure 10:
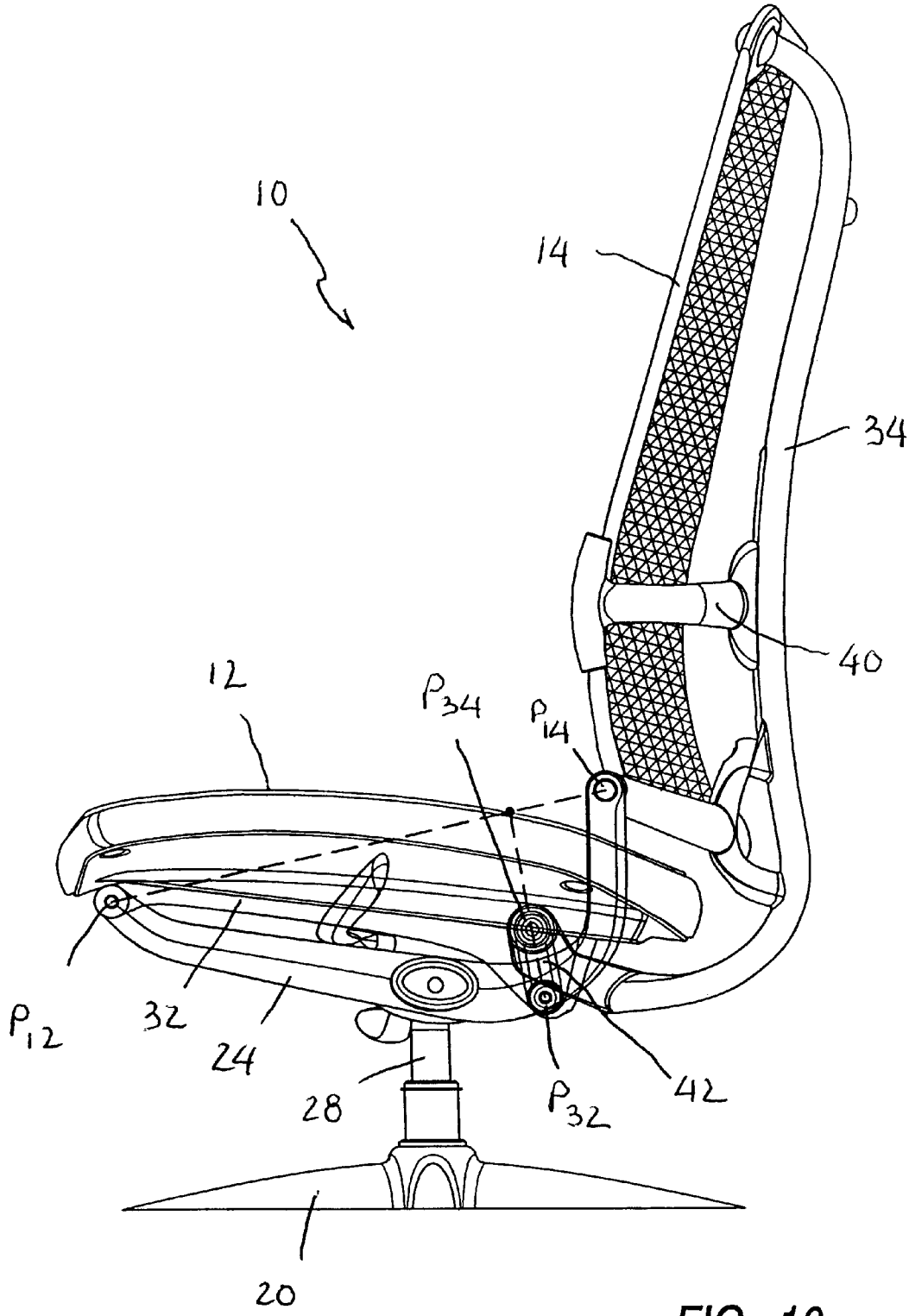
FIG. 10 is a partial left side view illustrating the chair in a fully upright position.
Figure 10A:
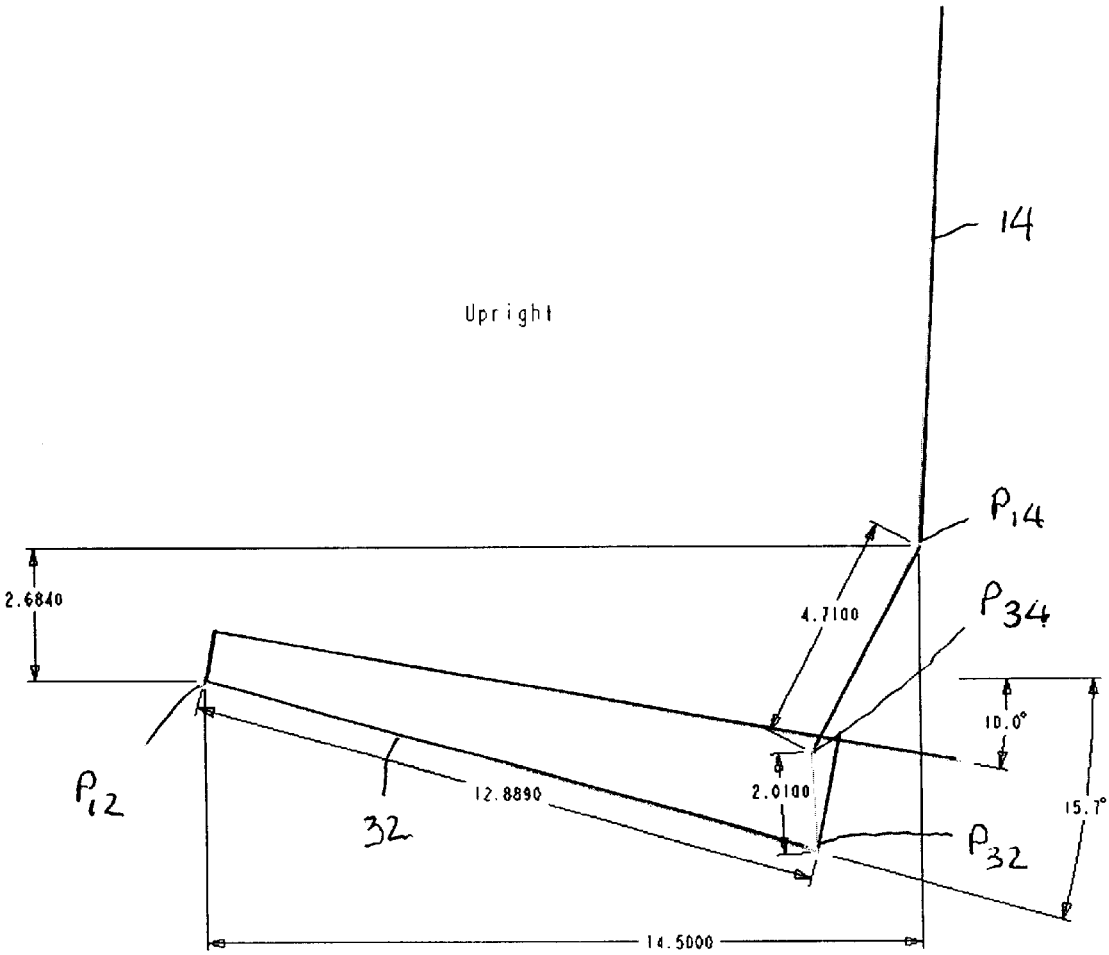
FIG. 10*a* is a side schematic view showing the preferred dimensional relationships between the chair components with the chair back in a fully upright position.
Figure 11:
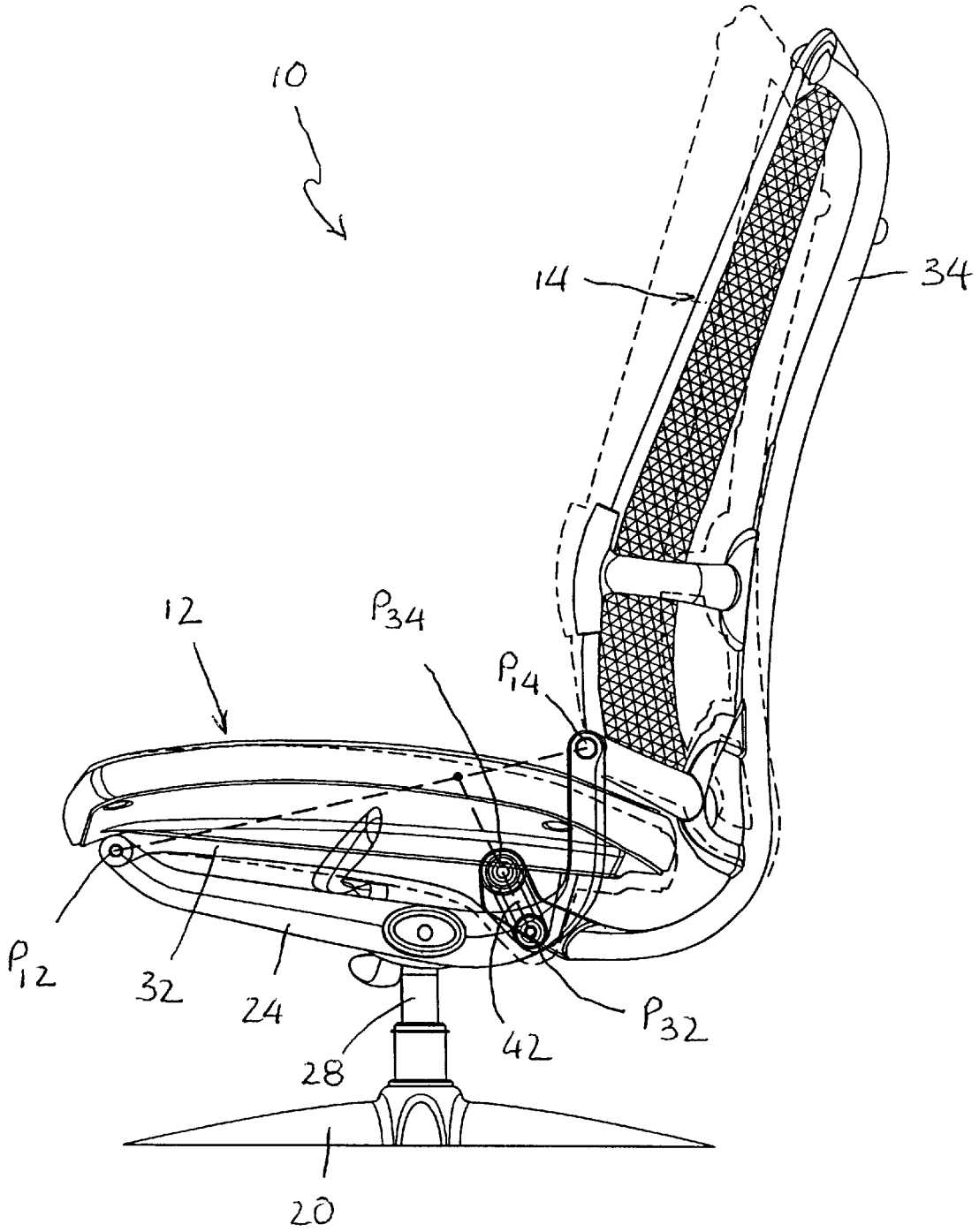
FIG. 11 is a partial left side view of the chair shown in a partially reclined position.
Figure 12:
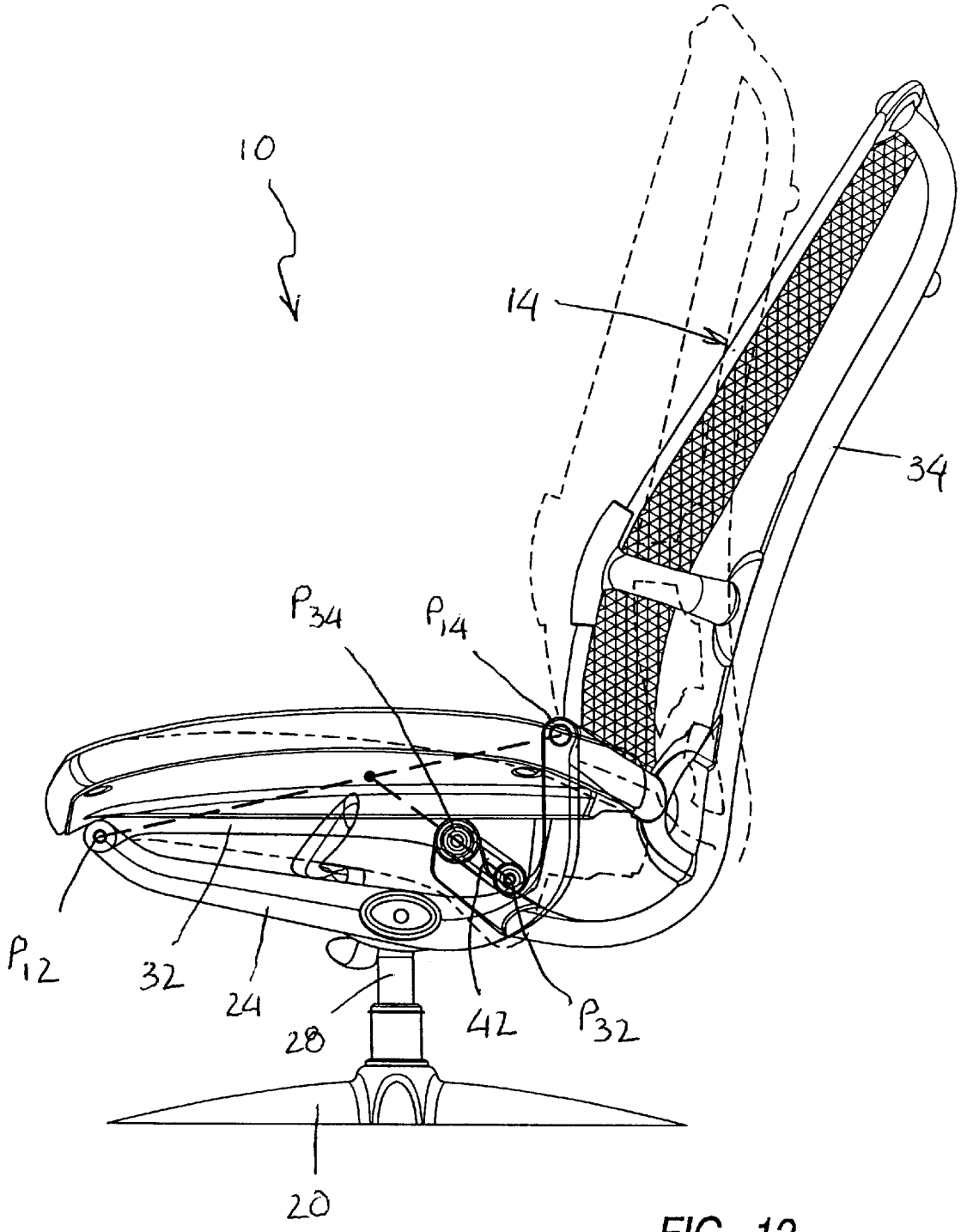
FIG. 12 is a partial left side view of the chair shown in a fully reclined position.
Figure 12A:
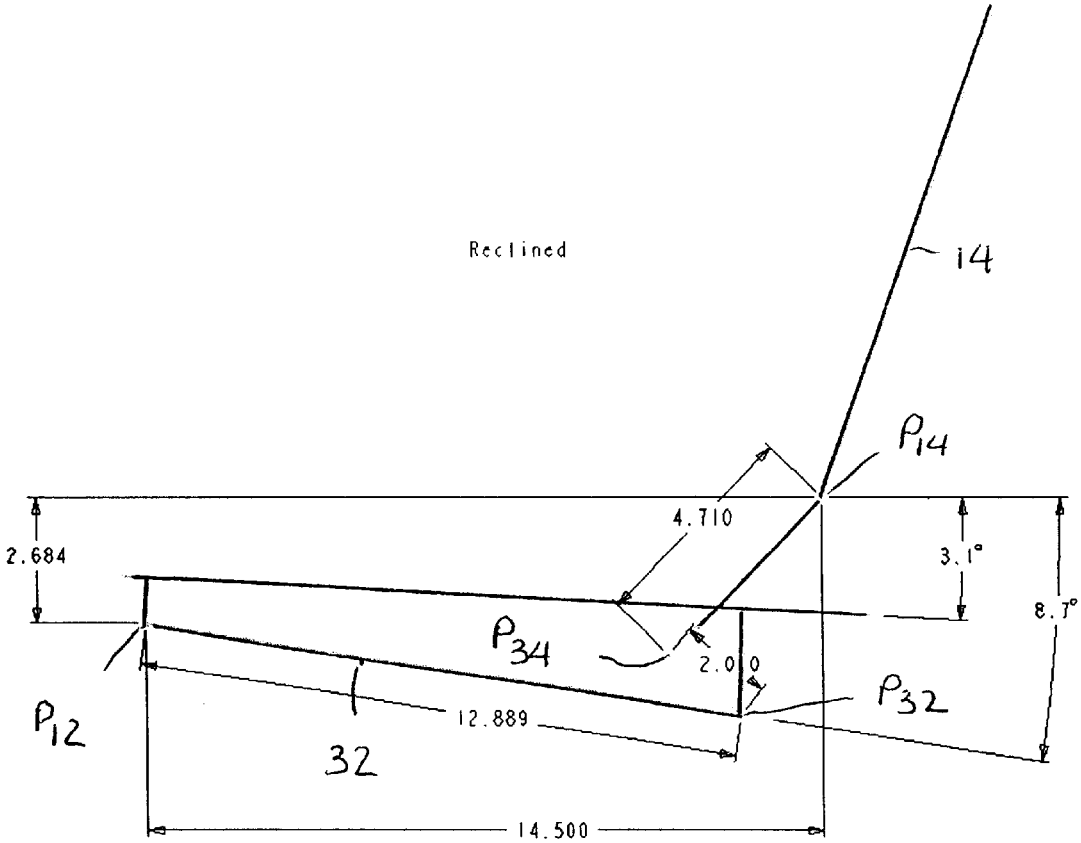
FIG. 12*a* is a side schematic view showing the preferred dimensional relationships between the chair components when the chair back is in a fully reclined position.

The relative positions of the seat 12 and back 14 of the chair 10, during reclining of the back 14, can be seen in the side views of FIGS. 10–12. As illustrated in these views, the chair seat pan 32 is pivotably connected at pivot points $P_{12}$ to the supports 24 (only one of which can be seen) and is pivotably connected at rear pivot points $P_{32}$ to a pair of links 42 (only one of which can be seen). Each link 42 in turn is pivotably connected at point $P_{34}$ to forward extensions of the back frame assembly 34. The back frame assembly 34 is also pivotably connected at point $P_{14}$ to the two supports 24. As shown in the dimensional schematic of FIG. 10*a*, when the chair back 14 is in a fully upright position the seat pan 32 in one preferred form is inclined to the rear and forms an angle of about 15.7 degrees from horizontal although this angle can be in a range of between about 10 and 20 degrees. The distance between pivot points $P_{12}$ and $P_{32}$ is about 12.889 inches and the distance between pivot points $P_{32}$ and $P_{34}$ of the links 42 is approximately 2.01 inches although these distances can be in ranges of between about 10 and 15 inches and about 1.5 to 2.5 inches, respectively. Further, the distance between pivot points $P_{14}$ and $P_{34}$ is approximately 4.71 inches while the horizontal distance between pivot points $P_{12}$ and $P_{14}$ is about 14.5 inches. The distance between pivot points $P_{41}$ and $P_{34}$ may be in the range of between about 3 and 6 inches while the distance between pivot points $P_{12}$ and $P_{14}$ may be in a range of between about 12 and 17 inches. As shown in the three stages of back tilt illustrated in FIGS. 10–12, as the back 14 reclines rearwardly, the link 42 moves in a counterclockwise direction of rotation causing the rear of the seat pan 32 to elevate relative to its front. In the fully reclined position of the back 14 as shown in the schematic of FIG. 12*a* the seat pan preferably reduces its angle of inclination with horizontal from 15.7 degrees (FIG. 10*a*) to 8.7 degrees while the afore-described distances between all pivot points remains constant. The reduced inclination angle may be in a range of between about 6 and 10 degrees. This synchronous motion of the seat pan 32 and back 14 provides for an exceptionally comfortable reclining motion of the chair 10 user to aid in avoiding fatigue as the user is performing various work-related tasks.

Figure 13:
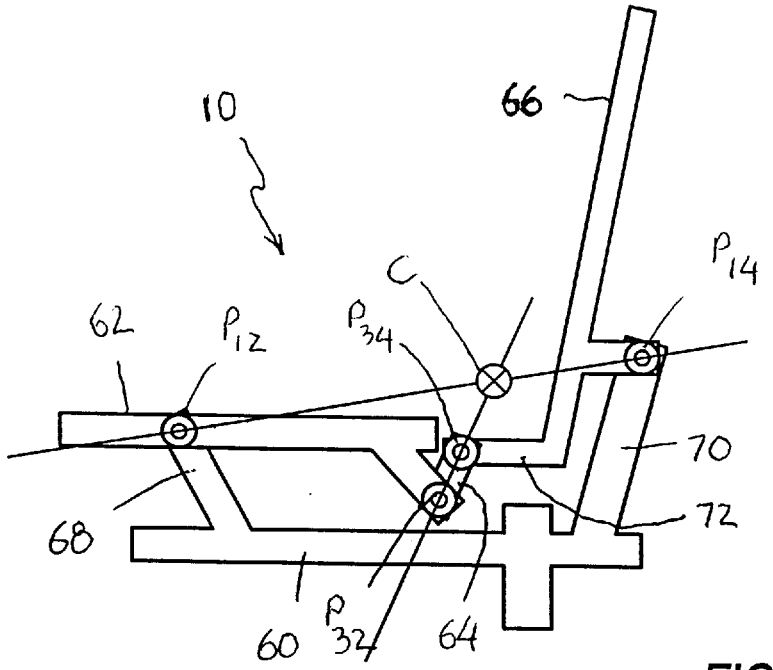
FIG. 13 is a side schematic view showing the linkage arrangement of the chair.
Figure 14:
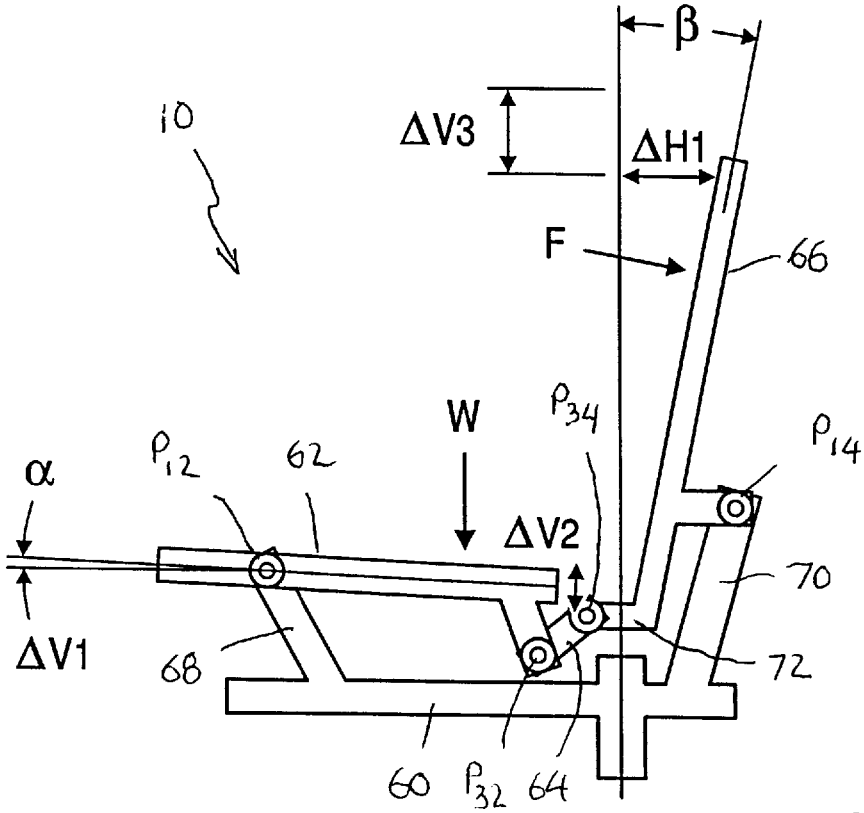
FIG. 14 is a side schematic view showing the kinematics of the chair.

Shown now in FIGS. 13 and 14 are schematic views of the synchronous seat and back tilt feature employing a four-bar mechanism which allows the rear of the seat to elevate as the backrest is reclined. The mechanism is designed to immediately respond to a user exerting a back force and/or self-weight on the seat. This function allows for reclining of the chair 10 about a rotation point C that is very closely coincident with the pivot axis of the user's hips and avoids undesirable "shirt pull" of the user. Because the rear of the seat is elevated during back reclining, excess pressure is relieved at the front underside of the user's thighs, and also a relatively constant gaze angle is maintained during reclining. This provides for adequate fluid circulation in the user's legs and avoids swelling. To accomplish the foregoing advantages, the chair 10 comprises four basic members and four rotationally-free pivots. The basic members include a floor supported member 60, a seat rest 62, a linking member 64 and a backrest 66. The floor supported member 60 has an upwardly directed portion 68 that terminates at an end defining pivot point $P_{12}$ to which the seat rest 62 is pivotably connected at its forward portion. The member 60 also has an upwardly directed portion 70 which terminates at an end defining pivot point $P_{14}$ to which the backrest 66 is pivotably connected. A lower portion 72 of the back rest 66 is pivotably connected at point $P_{34}$ to the linking member 64 and a downwardly extending portion 74 of the seat rest 62 is pivotably connected at point $P_{32}$ to the other end of the linking member 64.

The kinematics of the chair 10 are illustrated in FIG. 14. As force F is applied on the backrest 66, the back tilt angle $\beta$ increases, eye location shifts backwards an amount $\Delta H1$, and eye elevation decreases by an amount $\Delta V3$. The change in back tilt angle $\beta$ transmits motion by way of the upper and lower back pivots $P_{14}$ and $P_{34}$, respectively, to the linking member 64. As a result of motion set in linking member 64, the rear seat pivot $P_{32}$ moves in coordination with pivot $P_{34}$ in a composite rotational and translation motion. As the seat rest 62 rotates about pivot $P_{12}$, a lift $\Delta V2$ is caused in the rear part of the seat rest 62 relative to its front edge $\Delta V1$ in the amount $\Delta V2$-$\Delta V1$, therefore introducing a seat rest angle $\alpha$. The user sitting in the chair will feel a weight reduction effect as a result of the lift. The apparent weight reduction will be sensed as lightness and give the feel of comfort.

Figure 9:
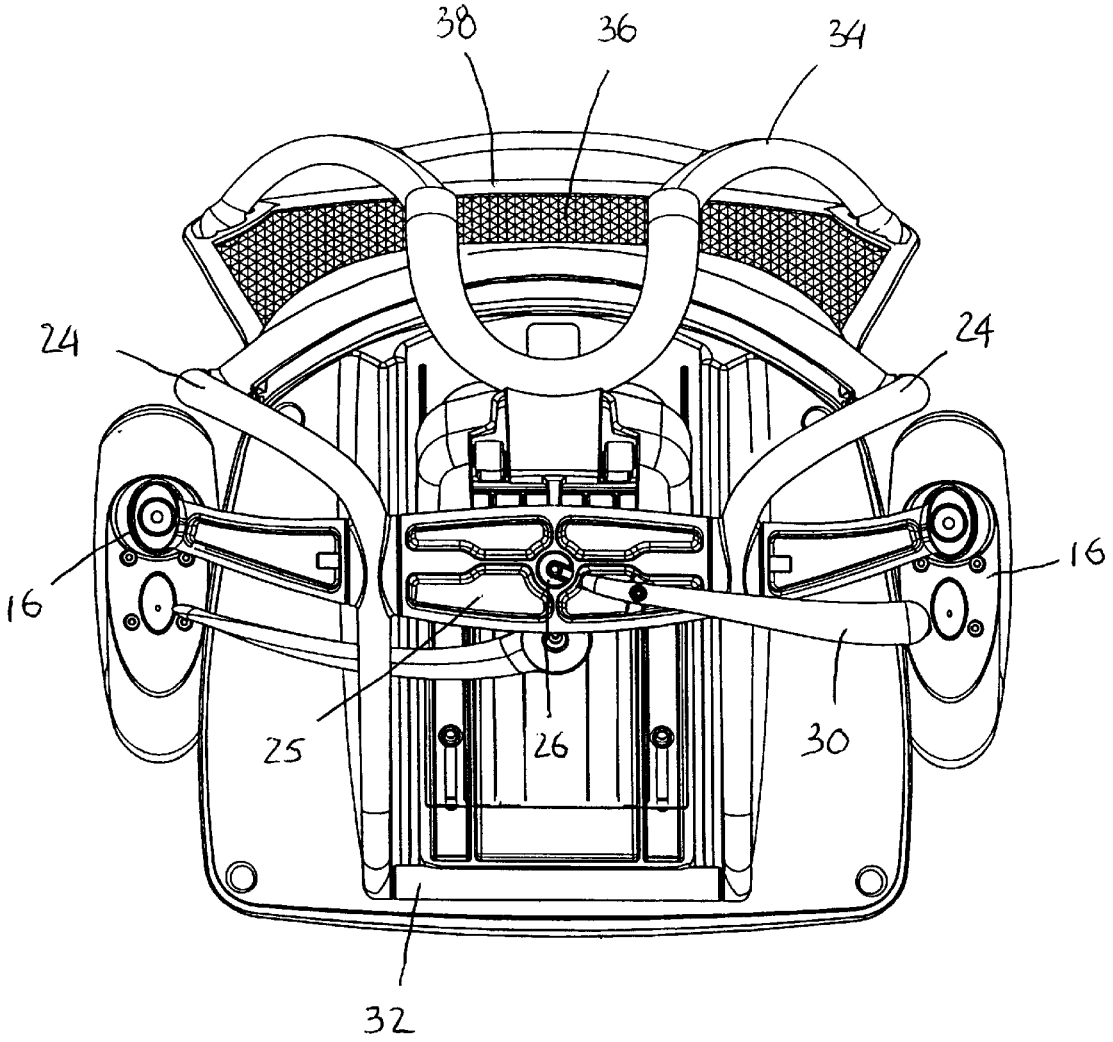
FIG. 9 is a bottom view thereof with the chair base removed.
Figure 9A:
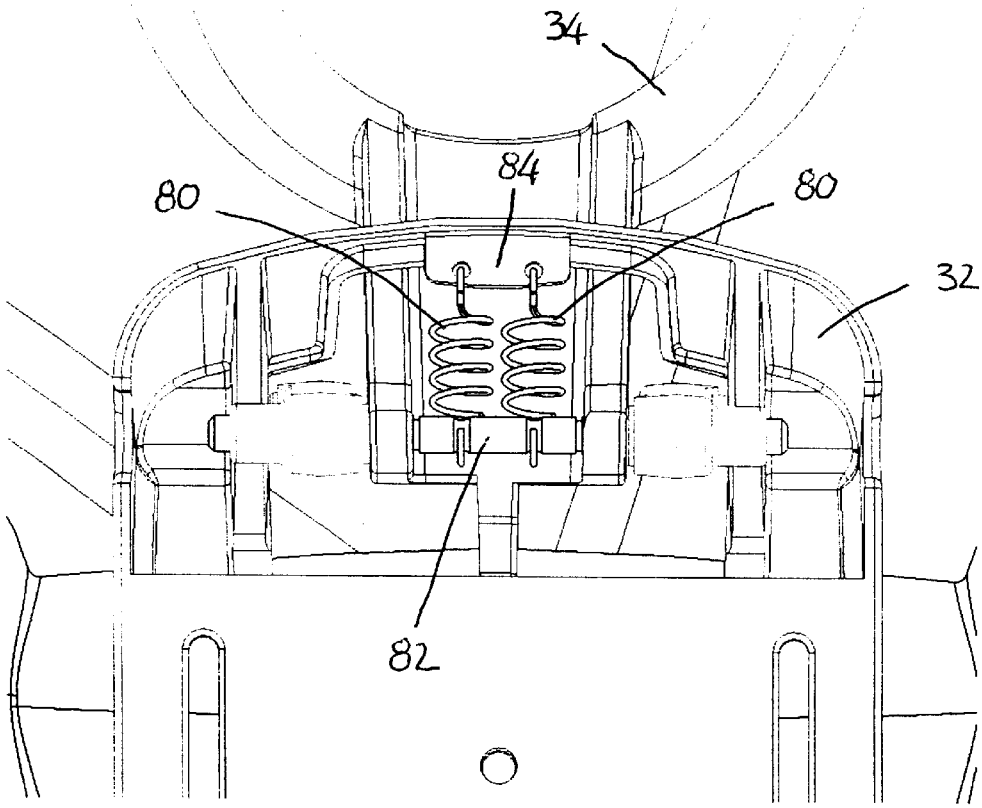
FIG. 9*a* is a partial top view of the chair seat with the cushion removed.

In order to assist the chair linkage mechanism in allowing the back 14 to maintain a fully upright position when the chair 10 is not in use, as shown in FIG. 9*a* one or more extension springs 80 may be connected between pivot shaft 82 and a rear edge portion 84 of the seat pan 32. The pivot shaft essentially defines pivot points $P_{34}$ and will cause a return force to be exerted on back frame assembly 34 by the springs 80.

It can now be appreciated that a chair 10 constructed according to the invention offers considerable advantages in user comfort by virtue of its synchronous linkage construction particularly where it is used for prolonged periods of time. The chair 10 is also cost effective to manufacture and assemble.

Figure 15:
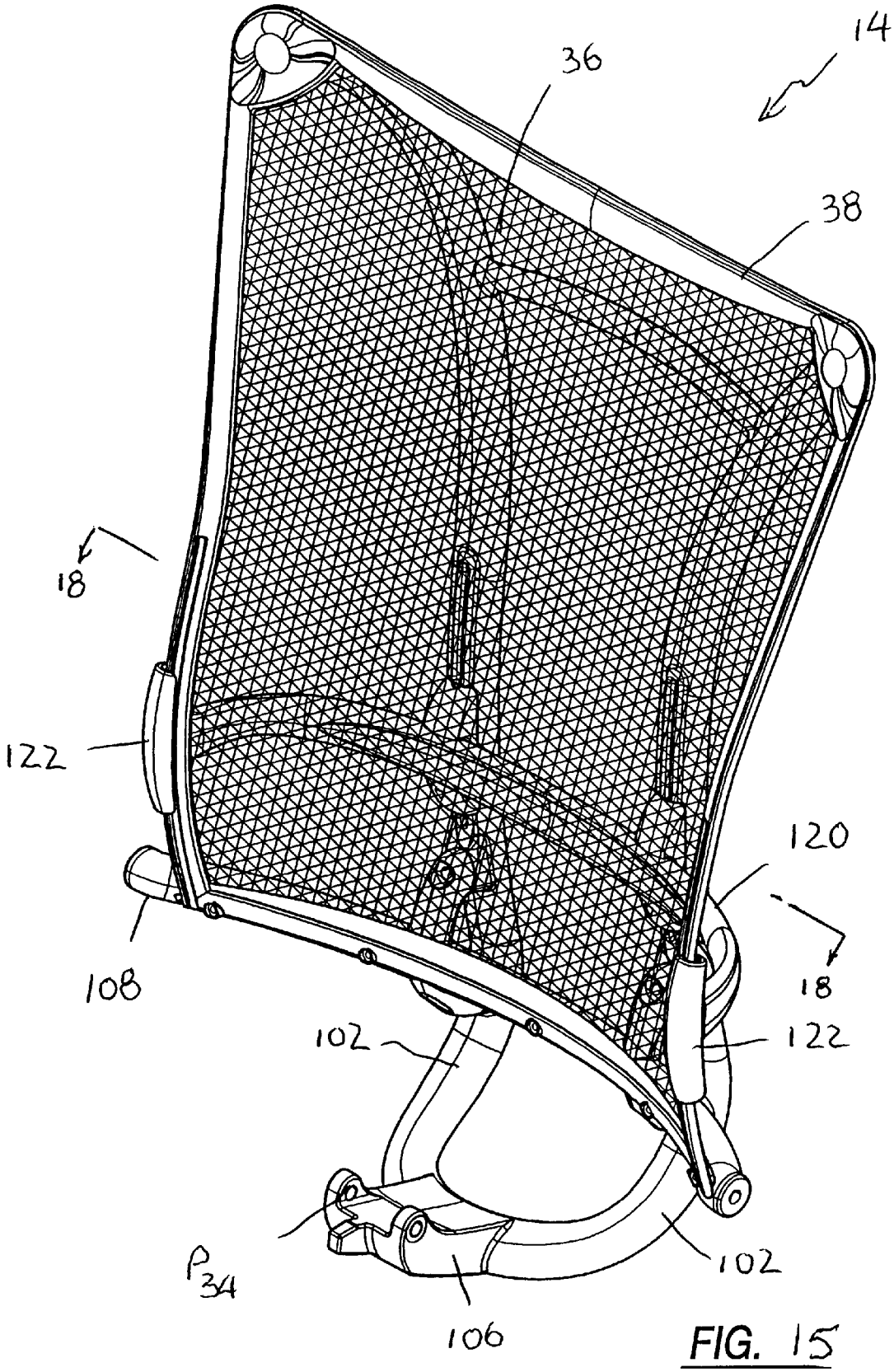
FIG. 15 is a front perspective view of the chair back assembly.
Figure 16:
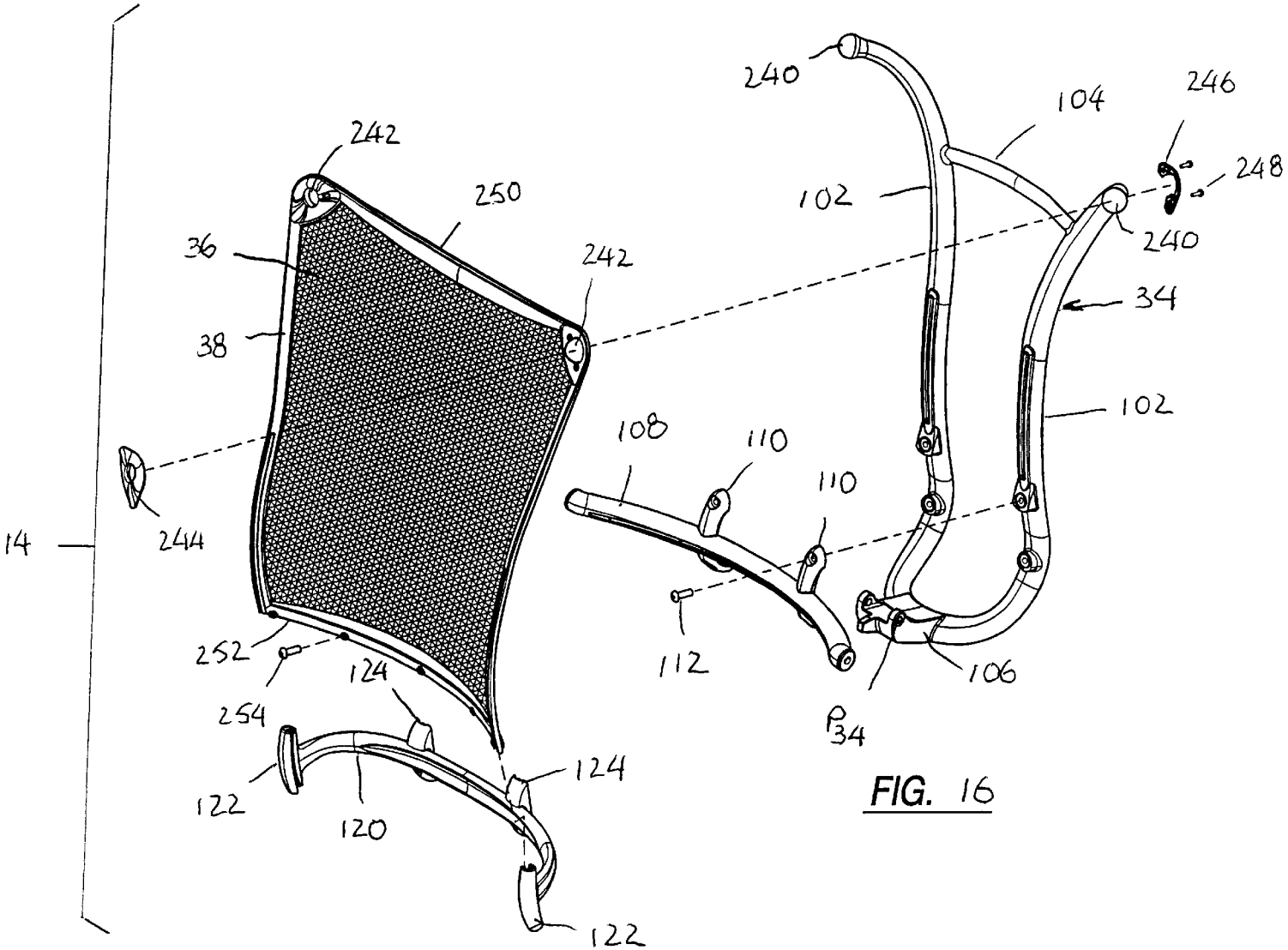
FIG. 16 is an exploded perspective view thereof.

Turning now to FIGS. 15 and 16, the complete back 14 of the chair is illustrated in perspective and shows the novel feature of the lumbar support construction. As earlier noted, the chair back 14 comprises a fabric mesh material 36 supported around its periphery by a semi-rigid bendable carrier 38. Main backframe member 34 consists in preferred form of two generally vertical supports 102 connected proximate their upper ends by a brace 104. The bottom ends of the supports 102 bend inwardly and terminate at a forwardly projecting member 106 which serves to provide aforementioned pivot point $P_{34}$. Transverse member 108 is provided with a pair of spaced arms 110 which are attached as by screws 112 to the two supports 102. The member 108 provides a lower attachment point for the carrier 38.

Figure 17:
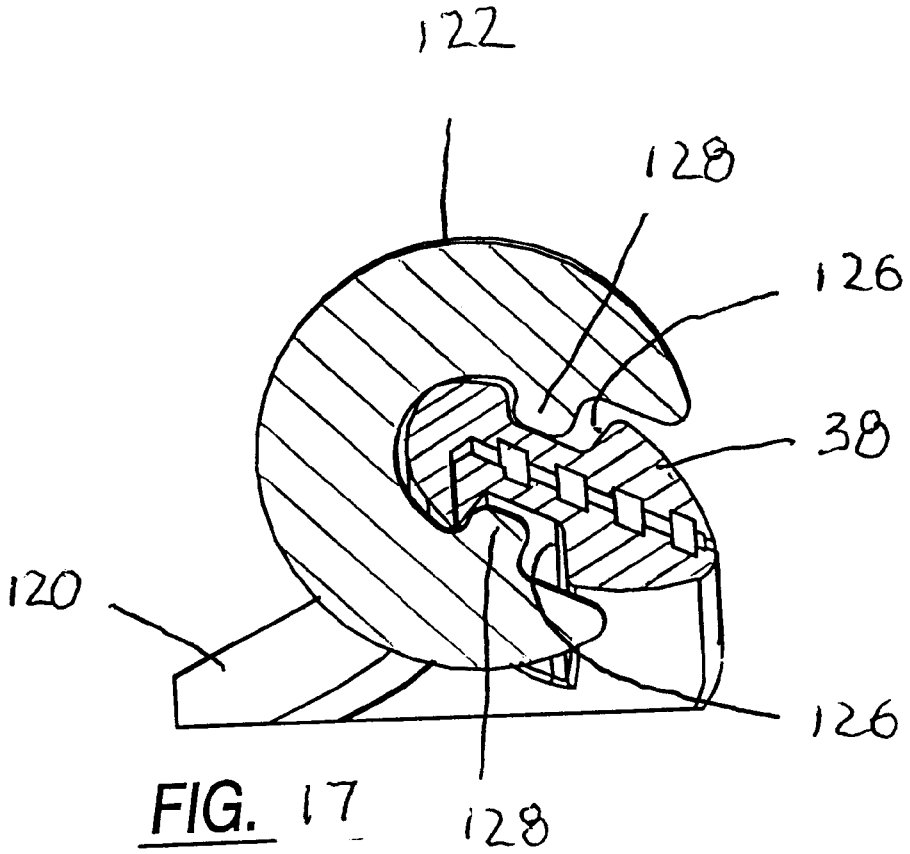
FIG. 17 is a cross-sectional view taken substantially along the line 17—17 of FIG. 15.

In accordance with the invention the back assembly 14 includes a transverse lumbar support tube 120 having gripping means 122 on each of its opposed ends, together with a pair of spaced slide members 124. A cross-section of the gripping means 122 can be seen in FIG. 17 wherein the carrier 38 is provided with a pair of opposed recesses 126 into which opposed projections 128 of the gripping means 122 are slideably received. Thus, the support tube 120 is slideable on opposed edges of the carrier 38.

Figure 18:
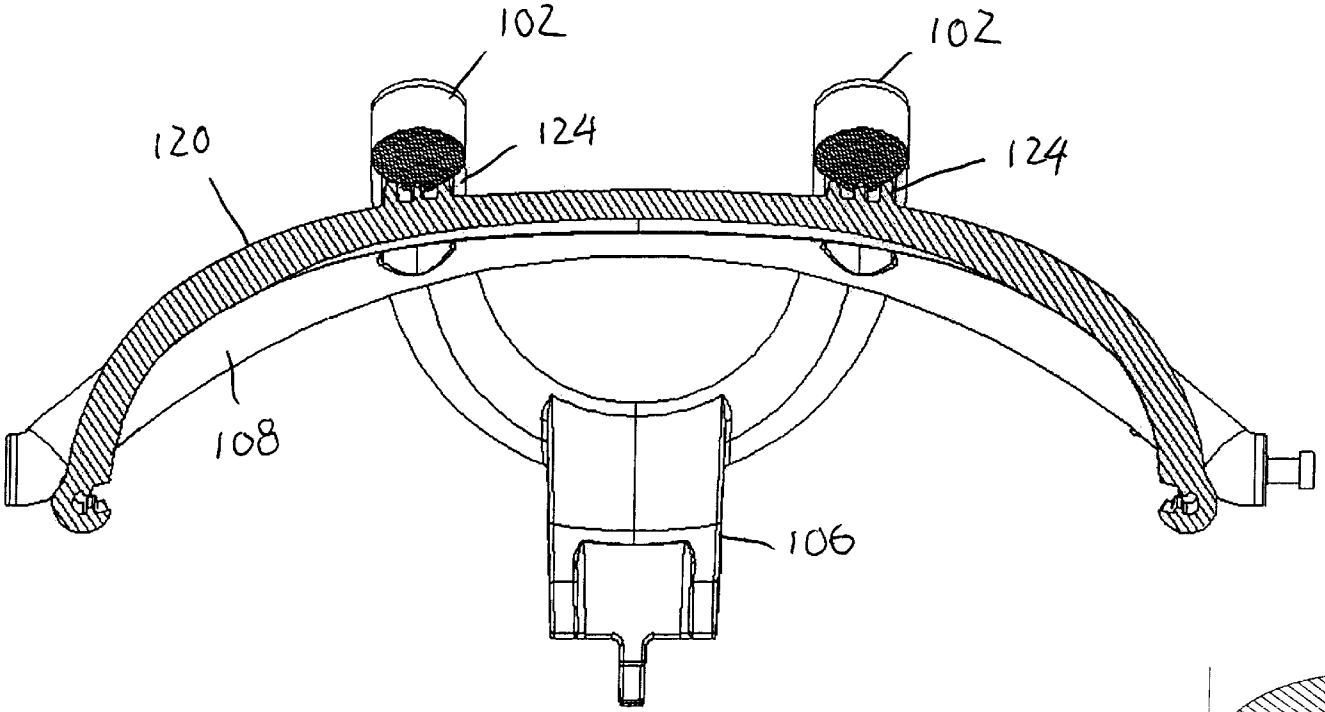
FIG. 18 is a cross-sectional view taken substantially along the line 18—18 of FIG. 15.
Figure 19:
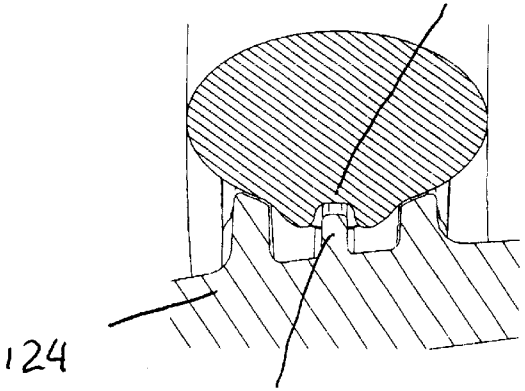
FIG. 19 is a cross-sectional view taken substantially along the line 19—19 of FIG. 15.
Figure 20:
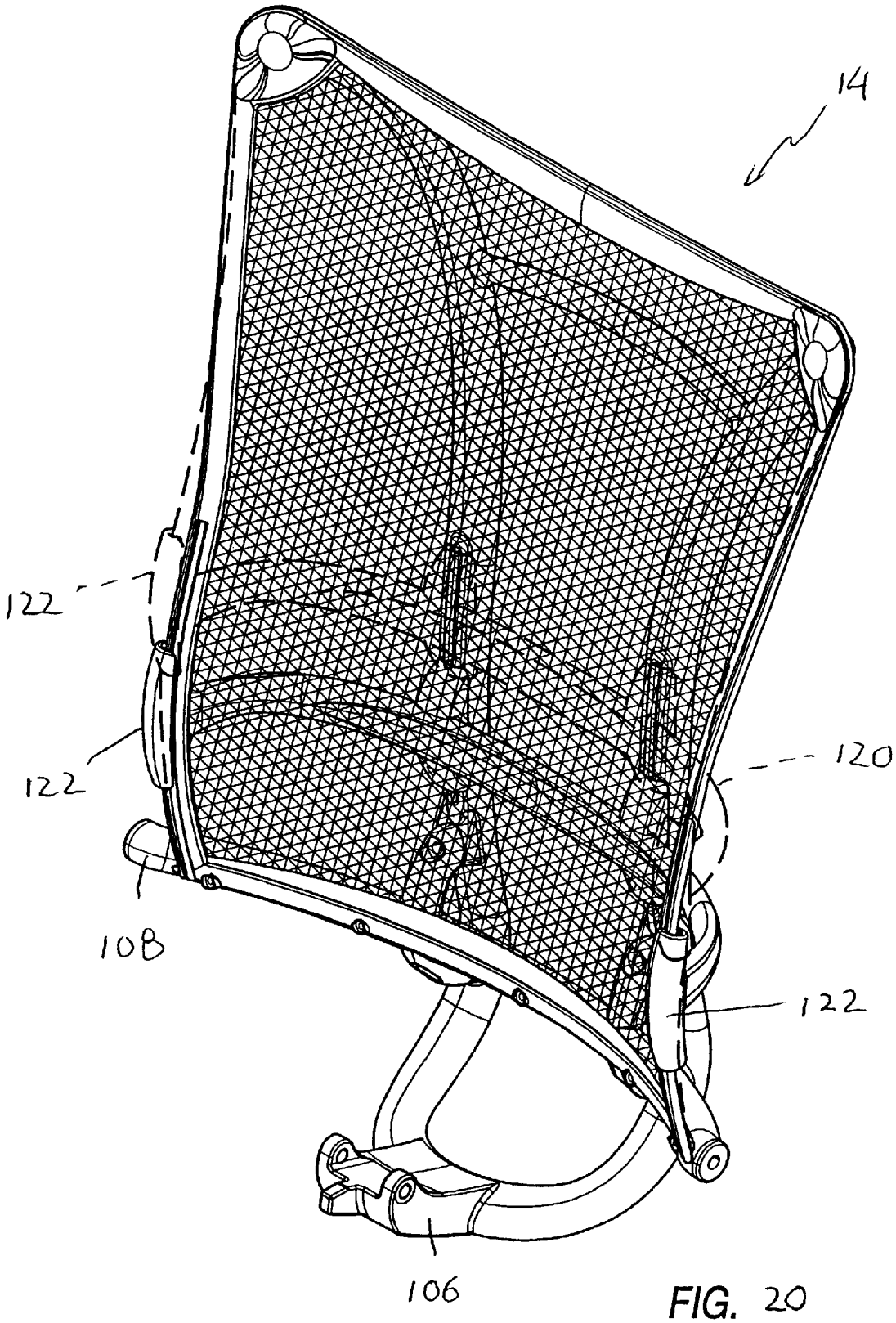
FIG. 20 is a perspective vie of the chair back illustrating the adjustability of the lumbar support.

FIG. 18 illustrates a cross-sectional view of the support tube taken substantially along the line 18—18 of FIG. 15. There, it can be seen that slide members 124 are configured to engage vertical supports 102. As shown in FIG. 19, the engagement arrangement of the slide members 124 includes simple vertical grooves 130 in the supports 102 engaging a central rib 132. It can now be appreciated, particularly with reference to FIG. 20, that the lumbar support tube 120 is vertically moveable between upper and lower positions as it slides on edges of the carrier 38 by means of the gripping means 122 and also slides on the vertical supports 102 by means of the slide members 124. The result of such movement is to allow the chair 10 user to adjust the vertical height of the tube 120 by simply manual manipulation. The tube 120 is held in proper connection to the supports 102 by just the tension of the carrier 38 and mesh 36 without the need for screws, adjustment knob or the like. In this tension mode the tube 120 causes the carrier 38 and mesh to be forced forwardly of chair 10 in the lumbar region of the user.

Figure 22:
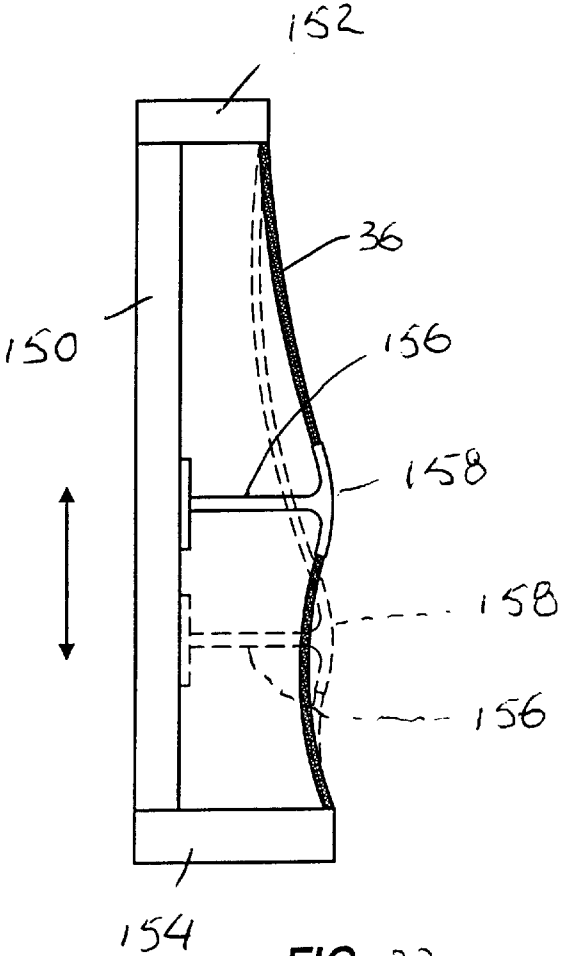
FIGS. 21–30 illustrate alternative constructions for the lumbar support.
Figure 21:
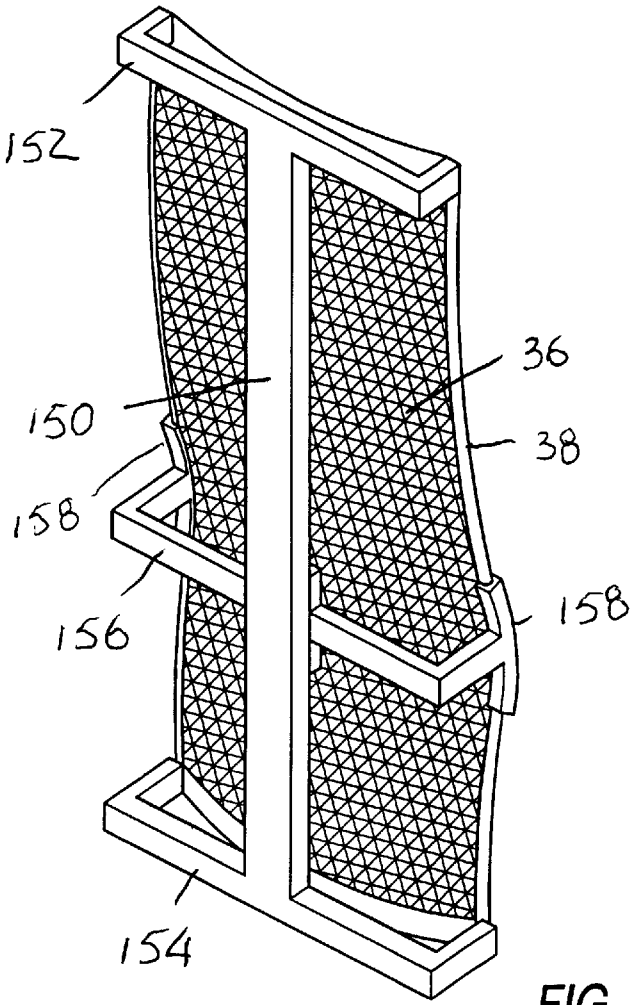

Alternative lumbar support systems using the mesh 36 and carrier 38 assembly can be seen in FIGS. 21–30. In FIGS. 21 and 22, it can be seen that a single central support 150 may be employed having top and bottom braces, 152 and 154, respectively, to secure the four corners of the carrier. A lumbar support tube 156 may be slideably supported on the central support 150 and have gripping means 158 for slideably gripping opposed edges of the carrier 38.

Figure 24:
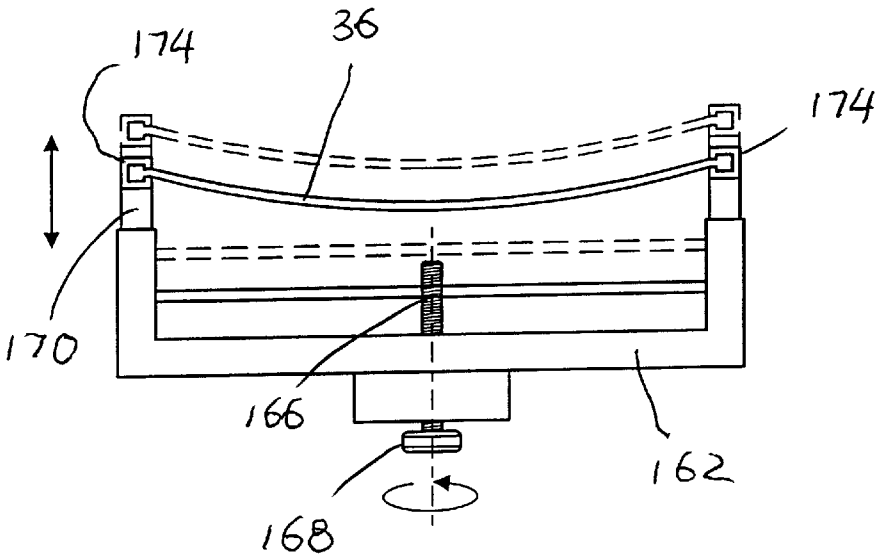
Figure 23:
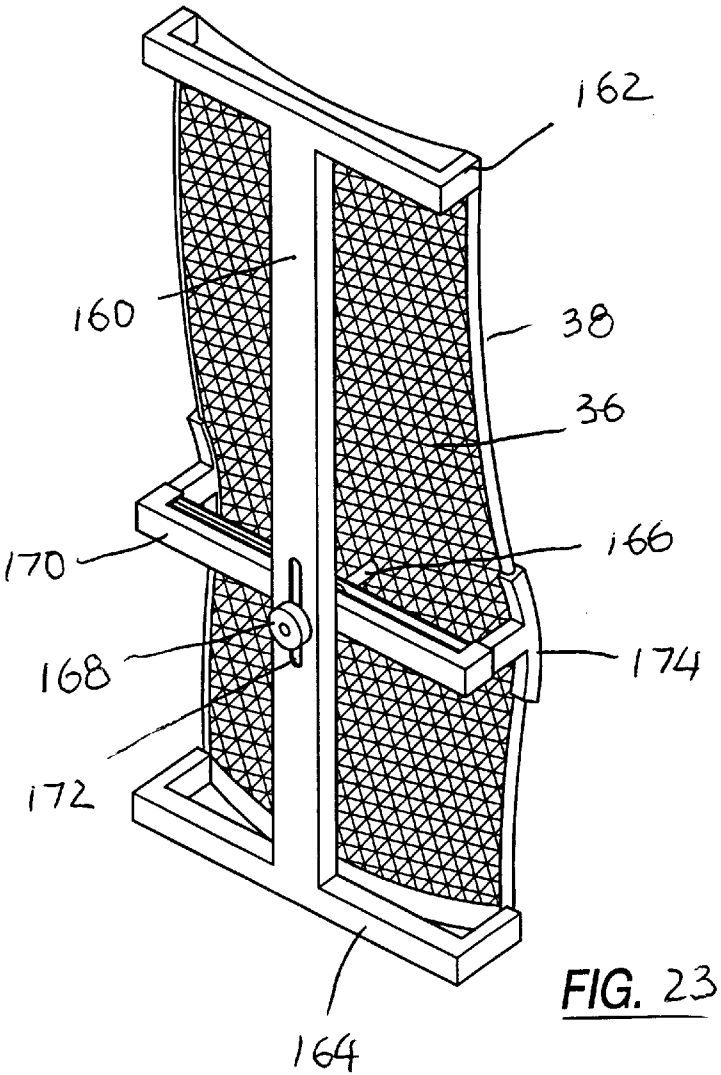

In FIGS. 23 and 24, a system is shown wherein a central support 160 and upper and lower braces, 162 and 164, respectively, a threaded rod 166 and knob 168 are employed to selectively move a lumbar support member 170 forwardly and rearwardly to adjust tension in the mesh 36. The system may also be constructed with a slot 172 through which the rod 166 passes to vertically adjust the member 170 as it slides on the carrier 38 using gripping means 174 as described above.

Figure 26:
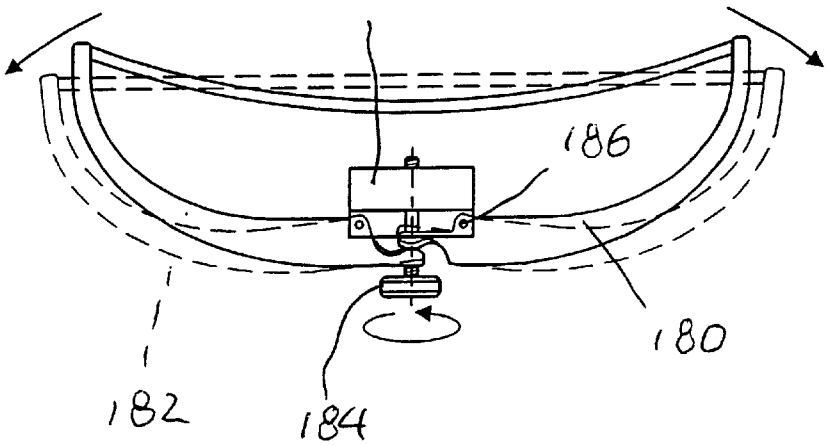
Figure 25:
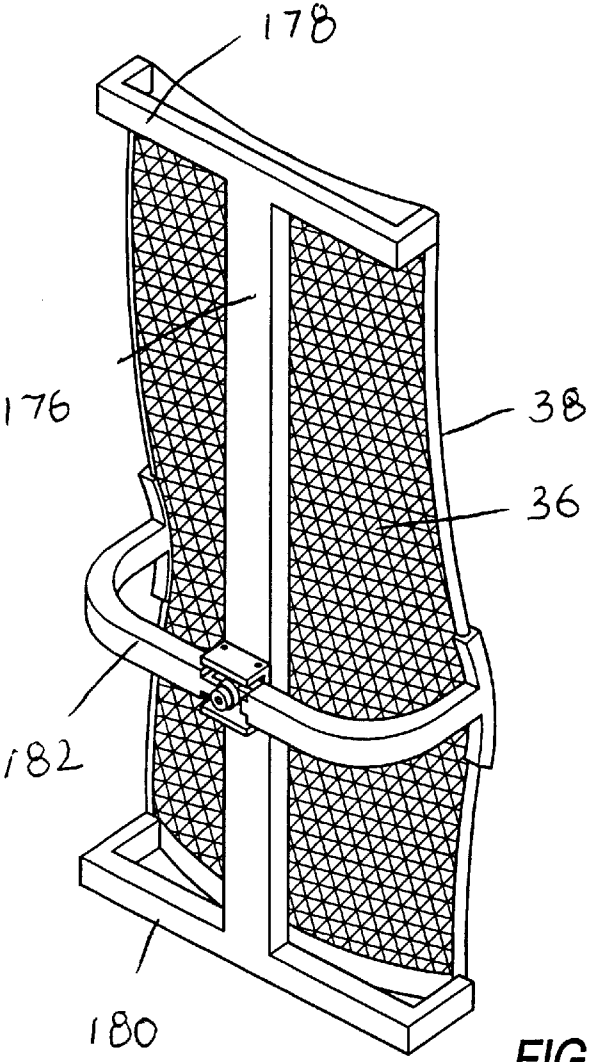

FIGS. 25 and 26 illustrate an embodiment wherein a central support 176 and braces 178 and 180 and braces 178 and 180 are used. However, a two piece lumbar support member 182 is employed to adjust tension in the mesh 36 by means of a manually rotatable knob 184 and camming device 186.

Figure 28:
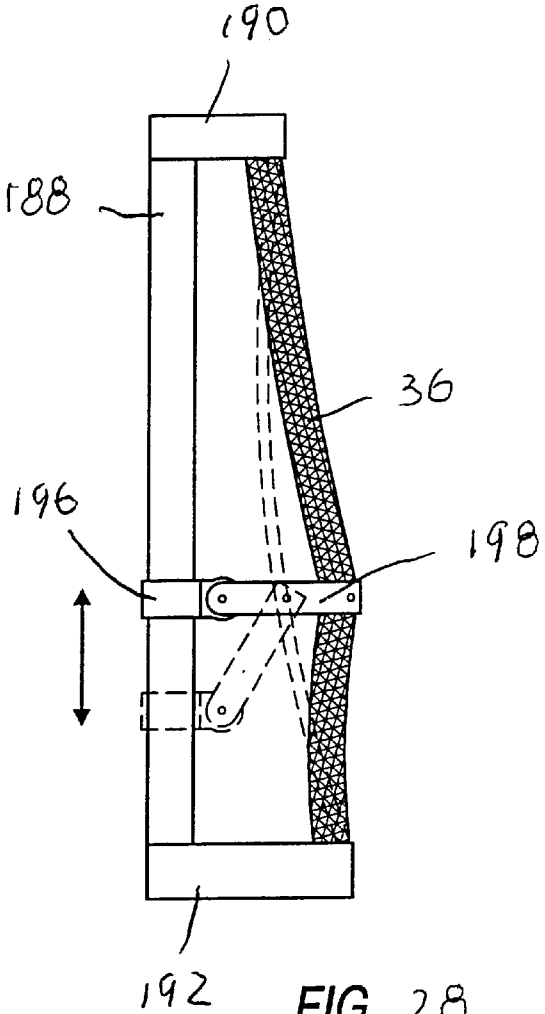
Figure 27:
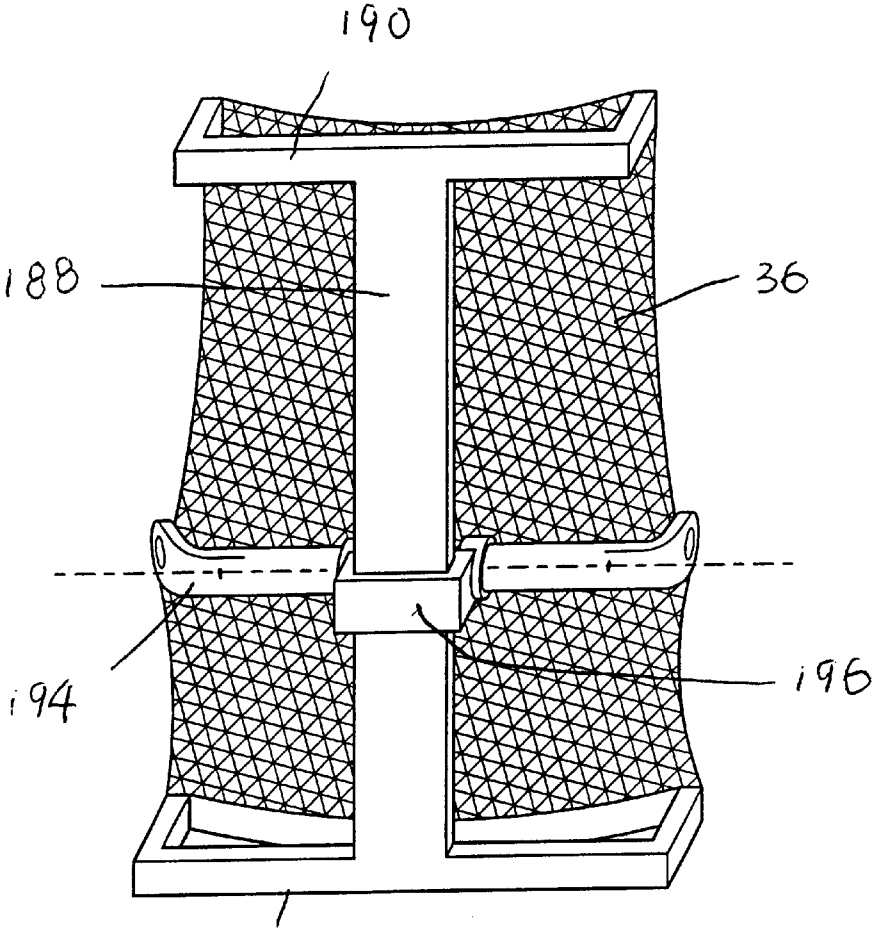

FIGS. 27 and 28 show yet another embodiment wherein a central support 188 and braces 190 and 192 are used. However, in this construction a lumbar support member 194 is connected by a slideable bracket 194 to the support 196 and uses a link member 198 to adjust tension in the mesh 36.

Figure 30:
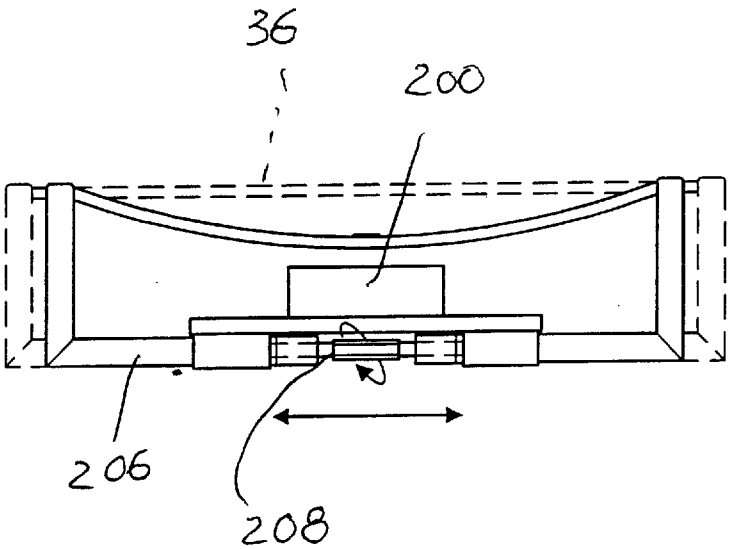
Figure 29:
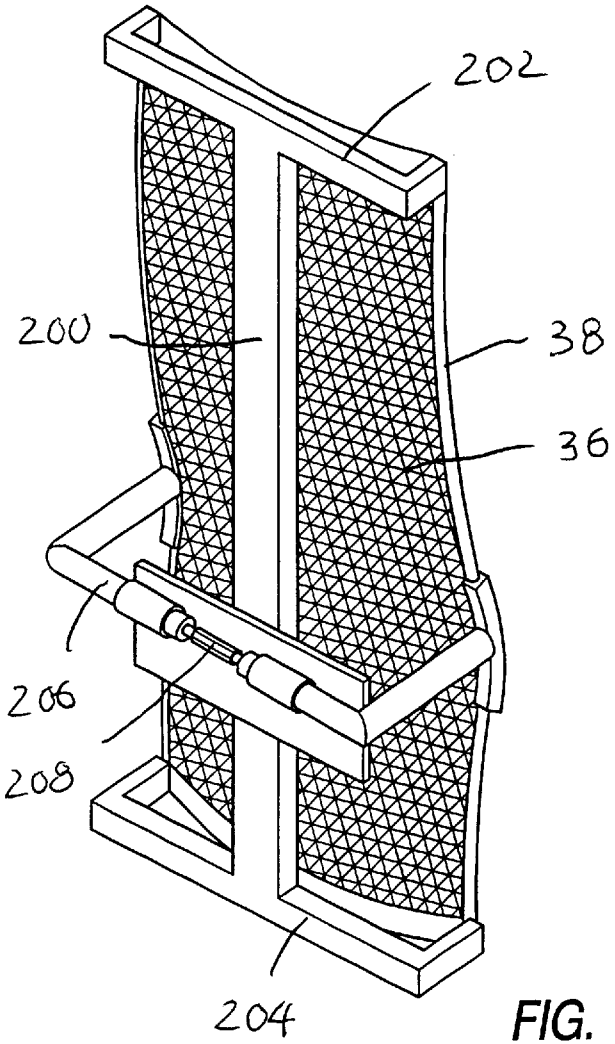

FIGS. 29 and 30 show a further embodiment wherein a central support 200 and braces 202 and 204 are used. In this construction a two piece lumbar support member 206 is employed using a turnbuckle assembly 208 to adjust tension in the mesh 36.

While the present invention has been described in connection with a preferred embodiment, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. A flexible back chair having a lumbar support assembly comprising:

said flexible back chair having a front and a rear;

at least one generally vertical support member disposed to the rear of the chair back; and a transverse member having means to engage said at least one vertical support, said transverse member having opposed ends with gripping means on each end for gripping opposed edges of said flexible back;

wherein said transverse member is configured to force said opposed edges of said flexible back forwardly of said chair back in the lumbar region of the chair user to provide support therefor.

2. The assembly of claim 1 wherein said flexible chair back comprises fabric.

3. The assembly of claim 2 wherein said fabric is of open mesh construction.

4. The assembly of claim 1 wherein said flexible back comprises a fabric member held around its periphery by a carrier member.

5. The assembly of claim 4 wherein said carrier member is semi-rigid and bendable.

6. The assembly of claim 4 wherein said gripping means are slotted to receive edges of said carrier member.

7. The assembly of claim 4 wherein said gripping means is slidable on said carrier member.

8. The assembly of claim 4 wherein said carrier has edges formed with slots therein and said gripping means are received in said slots.

9. The assembly of claim 8 wherein said slots and gripping means are cooperable to provide for selective vertical movement of said gripping means.

10. The assembly of claim 1 wherein said at least one vertical support member and said engaging means of said transverse member include complementary interfitting means permitting relative movement of said transverse member and at least one vertical support.

11. The assembly of claim 10 wherein said interfitting means includes a tongue and groove arrangement.

12. The assembly of claim 10 wherein said engaging means includes a tongue.

13. The assembly of claim 10 wherein said at least one vertical support includes a groove.

14. The assembly of claim 11 wherein said groove is elongate permitting vertical movement of said transverse member relative to said at least one generally vertical support.

15. The assembly of claim 1 including a pair of spaced generally vertical support members.

16. The assembly of claim 15 wherein said transverse member has a pair of engaging means each configured to engage one of said generally vertical supports.

17. The assembly of claim 16 wherein said generally vertical supports and said engaging means include complementary interfitting means permitting relative movement of said transverse member and said vertical supports.

18. The assembly of claim 17 wherein said interfitting means includes a tongue and groove arrangement.

19. The assembly of claim 17 wherein both engaging means include a tongue.

20. The assembly of claim 17 wherein both of said generally vertical support members include grooves.

21. The assembly of claim 18 wherein said grooves are elongate permitting vertical movement of said transverse member relative to said support members.

22. A flexible back chair having a lumbar support assembly comprising:

said flexible chair back having a front and a rear;

at least one generally vertical support member disposed to the rear of the chair back;

means slidable in a generally vertical direction on said at least one generally vertical support and having opposed ends;

gripping means on each of said opposed ends for slidably gripping opposed edges of said flexible back;

wherein said means slidable on said at least one generally vertical support is dimensioned and configured to force opposed edges of said flexible back forwardly of said chair back in the lumbar region of the chair user and is maintained in a preselected vertical position relative to said support by tension of said chair back.

23. The support assembly of claim 22 wherein said means slidable on said at least one generally vertical support includes a rigid transversely oriented member.

24. The assembly of claim 22 wherein said flexible chair back comprises fabric.

25. The assembly of claim 24 wherein said fabric is of open mesh construction.

26. The assembly of claim 22 wherein said flexible back comprises a fabric member held around its periphery by a carrier member.

27. The assembly of claim 26 wherein said carrier member is semi-rigid and bendable.

28. The assembly of claim 26 wherein said gripping means are slotted to receive edges of said carrier member.

29. The assembly of claim 22 wherein said means slidable on said at least one generally vertical support is connected to said at least one support by a tongue and groove arrangement.

30. The assembly of claim 22 wherein said at least one support includes an elongate groove.

31. A chair having a lumbar support comprising:

a base;

a seat connected to said base;

a back operatively connected to said base, said back being flexible and having upper, lower and lateral edges; and a transverse member having opposed ends with gripping elements for operative engagement with opposing lateral edges of said back wherein said transverse member flexes said back to adjust the tension thereof.

32. The chair as claimed in claim 31 wherein:

said flexible chair back comprises fabric; and said transverse member changes the tension in said fabric by moving vertically along the opposing lateral edges of said back.

33. The chair as claimed in claim 31 wherein:

said back includes a fabric center portion and a flexible peripheral frame with upper, lower and lateral edges; and said transverse member slidably engages opposed lateral edges of said frame.

34. The chair as claimed in claim 33 wherein:

said lower edge of said frame is attached to a chair frame member; and said transverse member is slidably engaged with a chair frame member.

35. A chair with a lumbar support member comprising:

a base;

a seat connected to said base;

a rigid frame member connected to said base;

a back having a fabric center portion mounted to a flexible peripheral carrier, said peripheral carrier having an upper, a lower and lateral side portions, said lower portion of said back being secured to said rigid frame member; and a lumbar support member having spaced apart connector elements slidably engaging the lateral side portions of said peripheral carrier whereby flexing of said peripheral carrier alters the tension of said fabric center portion.

36. The chair as claimed in claim 35 wherein:

said upper portion of said peripheral carrier includes spaced apart end portions connected to said rigid frame member.

37. The chair as claimed in claim 36 wherein:

said lower portion of said peripheral carrier is secured so as not to flex; and said lateral side portions and said upper portion of said peripheral carrier are connected to allow said lateral side portions and said upper portion to flex.

38. The chair as claimed in claim 37 wherein:

said lumbar support member is slidably engaged to said rigid frame member.

39. The chair as claimed in claim 35 wherein:

the fabric is of open mesh construction.

40. The chair as claimed in claim 35 wherein:

said gripping means are slotted to receive lateral edges of said carrier member.

41. The chair as claimed in claim 35 wherein:

said rigid frame member and said lumbar support member include complementary connector means permitting sliding movement of said lumbar support member.

42. The chair as claimed in claim 35 wherein:

said rigid frame member includes two generally vertically extending arms and said lumbar support member slidably connects to said two arms.

* * * * *